US012239252B2

(12) United States Patent
Kaplan et al.

(10) Patent No.: US 12,239,252 B2
(45) Date of Patent: Mar. 4, 2025

(54) CHRISTMAS TREE AND METHOD OF ASSEMBLING A TREE

(71) Applicant: BALSAM INTERNATIONAL UNLIMITED COMPANY, Dublin (IE)

(72) Inventors: Jonathan I. Kaplan, Palo Alto, CA (US); Ta-li Yu, San Francisco, CA (US); David Jason Wilkins, San Francisco, CA (US); Nathaniel C. Roland, Denver, CO (US)

(73) Assignee: BALSAM INTERNATIONAL UNLIMITED COMPANY, Dublin (IE)

( * ) Notice: Subject to any disclaimer, the term of this patent is extended or adjusted under 35 U.S.C. 154(b) by 16 days.

(21) Appl. No.: 17/970,365

(22) Filed: Oct. 20, 2022

(65) Prior Publication Data

US 2023/0043010 A1 Feb. 9, 2023

Related U.S. Application Data

(63) Continuation-in-part of application No. PCT/IB2021/053266, filed on Apr. 20, 2021.

(Continued)

(51) Int. Cl.
*A47G 33/12* (2006.01)
*A47G 33/06* (2006.01)

(52) U.S. Cl.
CPC ..... *A47G 33/12* (2013.01); *A47G 33/06* (2013.01); *A47G 2033/1266* (2013.01)

(58) Field of Classification Search
CPC ..... A47G 33/12; A47G 33/06; A47G 2033/1266; A47G 2033/1253; A47G 2033/1273; A47G 2033/122

(Continued)

(56) References Cited

U.S. PATENT DOCUMENTS 2,763,454 A * 9/1956 Lindsell ..... A47G 33/12 248/140
3,808,082 A * 4/1974 Steiber ..... A47G 33/06 428/20

(Continued)

FOREIGN PATENT DOCUMENTS

GB 2130881 A 6/1984
WO 2005023062 A2 3/2005
WO 2018136820 A1 7/2018

OTHER PUBLICATIONS

Applicant: Balsam International Unlimited Company; Australian Application No. 2021260175; Examination Report No. 1 dated Oct. 3, 2023; 5 pgs.

(Continued)

*Primary Examiner* — Muhammad Ijaz
(74) *Attorney, Agent, or Firm* — Tarolli, Sundheim, Covell & Tummino LLP

(57) ABSTRACT

An artificial Christmas tree includes an elongated trunk extending between proximal and distal ends thereof. A base may support the trunk of the artificial tree in an upright position relative to floor. The proximal end of the trunk may be coupled to the base and the distal end of the trunk extending outwardly from the base. A plurality of frame sections may extend circumferentially around the trunk and being moveable in an axial direction relative to the trunk. Each frame section may extend longitudinally between axially spaced apart ends thereof and being connected with at least one other frame section, whereby axial movement of a given frame section along the trunk causes corresponding axial movement of each other frame section to which the given frame section is connected.

17 Claims, 22 Drawing Sheets

Related U.S. Application Data

(60) Provisional application No. 63/012,552, filed on Apr. 20, 2020.

(58) Field of Classification Search
USPC ..... 248/519; 428/18
See application file for complete search history.

(56) References Cited

U.S. PATENT DOCUMENTS 5,161,768 A * 11/1992 Sarabin ..... A47G 33/12 248/188.7
5,797,579 A * 8/1998 Krinner ..... A47G 33/1213 248/524
8,166,702 B1 * 5/2012 Laface ..... A47G 33/12 47/40.5
10,092,125 B1 * 10/2018 Braunberger ..... A47G 33/12
10,213,041 B1 * 2/2019 Fonseca ..... F21V 23/002
10,321,781 B2 * 6/2019 Hendricks ..... A47G 33/12
11,525,565 B1 * 12/2022 Liu ..... F21V 33/0028
11,641,968 B1 * 5/2023 Zou ..... A47G 33/126 362/249.14
11,744,392 B1 * 9/2023 Richards ..... A47G 33/12 47/40.5
11,918,132 B2 * 3/2024 Ocegueda Gallaga ..... A47G 33/12
2005/0048226 A1 * 3/2005 Gary ..... A47G 33/06 428/18
2008/0038490 A1 * 2/2008 Tennison ..... A47G 33/06 428/18
2013/0301245 A1 * 11/2013 Chen ..... A41G 1/005 362/123
2013/0301246 A1 * 11/2013 Chen ..... F21V 23/02 362/123
2017/0196391 A1 * 7/2017 Schooley ..... A47G 33/06
2019/0357717 A1 * 11/2019 Hendricks ..... A47G 33/06
2021/0030092 A1 * 2/2021 Falk ..... A41G 1/007
2022/0354291 A1 * 11/2022 Robertson ..... A47G 33/06

OTHER PUBLICATIONS

Applicant: Balsam International Unlimited Company; International Application No. PCT/IB2021/053266 Filed: Apr. 20, 2021; PCT International Search Report and Written Opinion; Jul. 21, 2021; 11 pgs.

* cited by examiner

CHRISTMAS TREE AND METHOD OF ASSEMBLING A TREE

CROSS-REFERENCE TO RELATED APPLICATIONS

This application is a continuation-in-part of International Application No. PCT/IB2021/053266, filed Apr. 20, 2021, and entitled CHRISTMAS TREE AND METHOD OF ASSEMBLING A TREE, which claims the benefit of priority to U.S. provisional patent application No. 63/012,552, filed Apr. 20, 2020, each of which is hereby incorporated by reference in its entirety.

TECHNICAL FIELD

This disclosure relates to an artificial Christmas tree and to a method of assembling an artificial Christmas tree.

BACKGROUND

When decorating a space, it is often desirable to include trees as part of such decorations. To extend the useful life of such decorations without maintenance and allow for repeated cycles of storage and deployment of such decorations, it is desirable to provide artificial trees rather than live trees. An example of such decorations are Christmas trees typically deployed during holiday seasons occurring at the end of each calendar year.

Some artificial Christmas trees are tall (e.g., ten feet or greater). These tall trees often require the use of ladders and, in some cases, cherry pickers or other lift equipment, to set up and decorate the trees. This tends to increase the time to set up and decorate as well as the overall the cost of the tree (e.g., in terms of both personnel and equipment).

SUMMARY

This disclosure relates to an artificial Christmas tree and to a method of setting up an artificial Christmas tree.

In an example, an artificial Christmas tree includes a plurality of frame sections adapted to be assembled to form a tree frame. The tree frame has an outer frame portion adapted to support artificial tree features. The artificial Christmas tree also includes a hoist adapted to move one or more of the frame sections in a longitudinal direction of the tree frame.

In another example, an artificial Christmas tree includes a base and an elongated support. The support has a proximal end portion coupled to the base and an opposite distal end portion. The support is adapted to move relative to the base between a prone position and an erect position, and the distal end portion is above the base in the erect position.

In yet another example, a method includes erecting an elongated support of an artificial Christmas tree so a distal end portion of the support is above an opposite proximal end portion of the support. The method also includes positioning a first frame section relative to the support. The method also includes moving the first frame section along the support toward the distal end portion of the support. The method also includes positioning a next frame section beneath the first frame section, and coupling the next frame section to the first frame section.

DETAILED DESCRIPTION

Figure 1:
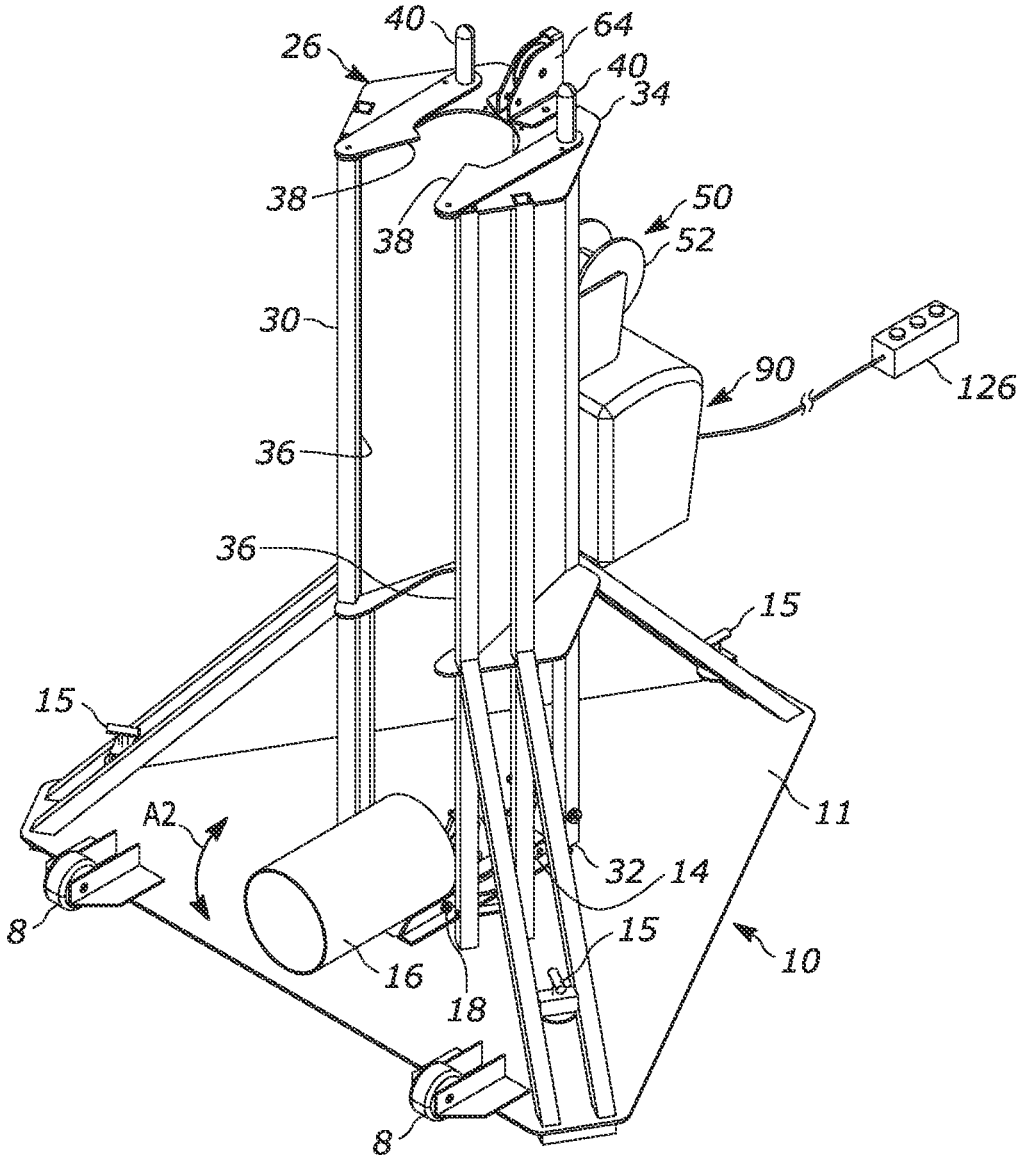
FIGS. 1 and 2 depict an example of a base.

This disclosure relates to an artificial Christmas tree and to a method of setting up an artificial Christmas tree.

As an example, the artificial Christmas tree includes a plurality of frame sections adapted to be assembled to form a tree frame. The tree frame has an outer frame portion adapted to support artificial tree features (e.g., branches). The artificial Christmas tree also includes a hoist adapted to move one or more of the frame sections in a longitudinal direction of the tree frame above an assembly location. As used herein, the term hoist can refer to a device and/or an action for raising up an object. For example, hoisting can including lifting the object from an elevated position above the object or lifting the object from a lower position that is below part of the object. Advantageously, the artificial tree features (e.g., branches, ornaments, lights and other decorations) may be applied to (or removed from) respective frame sections while each frame section is within physical reach of a user. As a result, the user does not need the use of ladders, cherry pickers or other lift equipment to set up and decorate the tree.

In some examples, the artificial Christmas tree includes a base and an elongated support. The elongated support is adapted to move relative to the base between a prone position and an erect position. For example, the artificial Christmas tree includes a hoist coupled to the base and/or support to move the support between respective prone and erect positions. While in the erect position, in which the distal end portion of the support is above the base, frame sections may be positioned and moved along the support toward the distal end portion of the support. As described herein, branches and/or other decorations may be coupled to the frame sections and the branches decorated before being moved upwardly along the support. A next frame section can be coupled to a preceding frame section. Branches are then coupled to the next frame section, which can be decorated without the use of ladders or other lift equipment. The process can be repeated until the assembly of the artificial Christmas tree is complete. A similar process may be implemented to disassemble the artificial Christmas tree by adjusting the height of the frame sections and removing branches and decorations (if desired), again without the use of ladders or other lift equipment.

As used herein, the term artificial simply means that the tree is not a live tree; however, parts of the tree may be synthetic materials, natural materials or a combination of natural and synthetic materials. For example, an artificial Christmas tree can refer to an artificial version of a conifer tree, such as an evergreen type of tree (e.g. a spruce, pine or fir tree). While the branches of a Christmas tree are usually green in color, such trees may be any color and may be lighted or unlit. As used herein, prone refers to a generally horizontal position, such as lying on the ground or another surface (e.g., a more horizontal than vertical orientation). Also, as used herein, erect refers to an upright or generally vertical position with respect to the ground or another surface (e.g., a more vertical than horizontal orientation).

Figure 2:
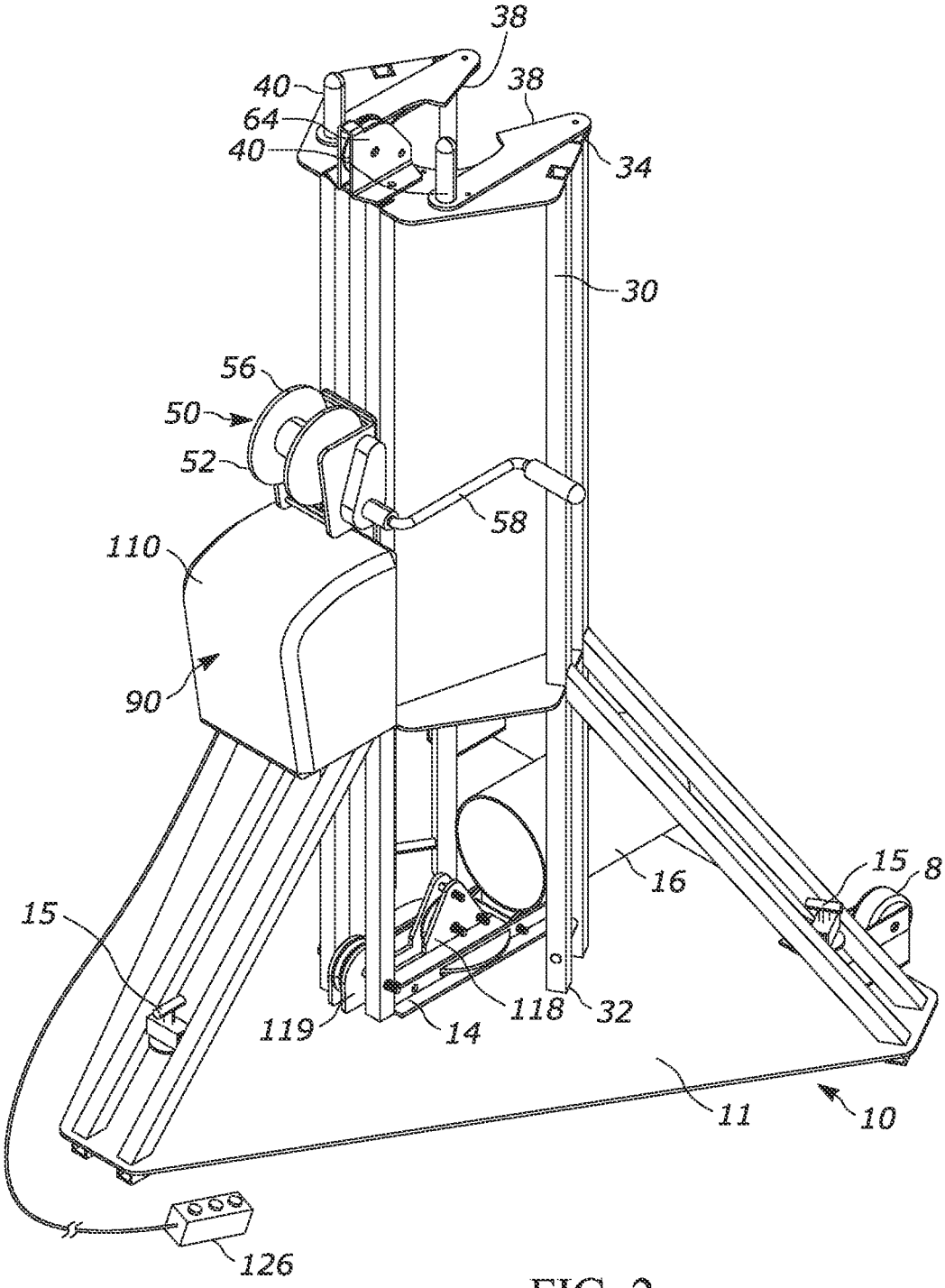

FIGS. 1 and 2 depict an example of a base 10 that is part of an artificial Christmas tree 200. The base 10 includes a central portion 11 that may be placed on a surface (e.g., ground) at a desired display location. For example, to facilitate moving the base 10 to the desired display location, the base 10 can include one or more wheels (e.g., a pair of wheels, three wheels, four wheels or more) 8 coupled to at or near a respective edge of the central portion 11. The wheels 8 may be coaxial or otherwise arranged to facilitate controlled movement of the base 10 across the surface. A bracket (or other support structure) can be arranged and configured to support the respective wheels 8 with respect to the central portion 11 so the wheels 8 do not engage the surface until the base 10 is tilted (or pivoted) onto the wheels 8. In this way, the base 10 remains stable (e.g., difficult to move) due to contact between the central portion 11 and the surface until the base 10 is tilted onto the wheels 8 enable rolling movement of the base across the surface. In another example, retractable caster wheels 8 can be coupled to the central portion 11 and remain retracted until activated (e.g., by stepping on or otherwise moving a respective foot pedal). When activated, the retractable wheels 8 can elevate the base 10 above surface to facilitate movement of the base across the surface. Using retractable wheels enables the base to be moved easily before assembly, during assembly or after assembly. In other examples, the base 10 may be carried, slid or otherwise transported to the desired display condition without wheels.

Figure 5:
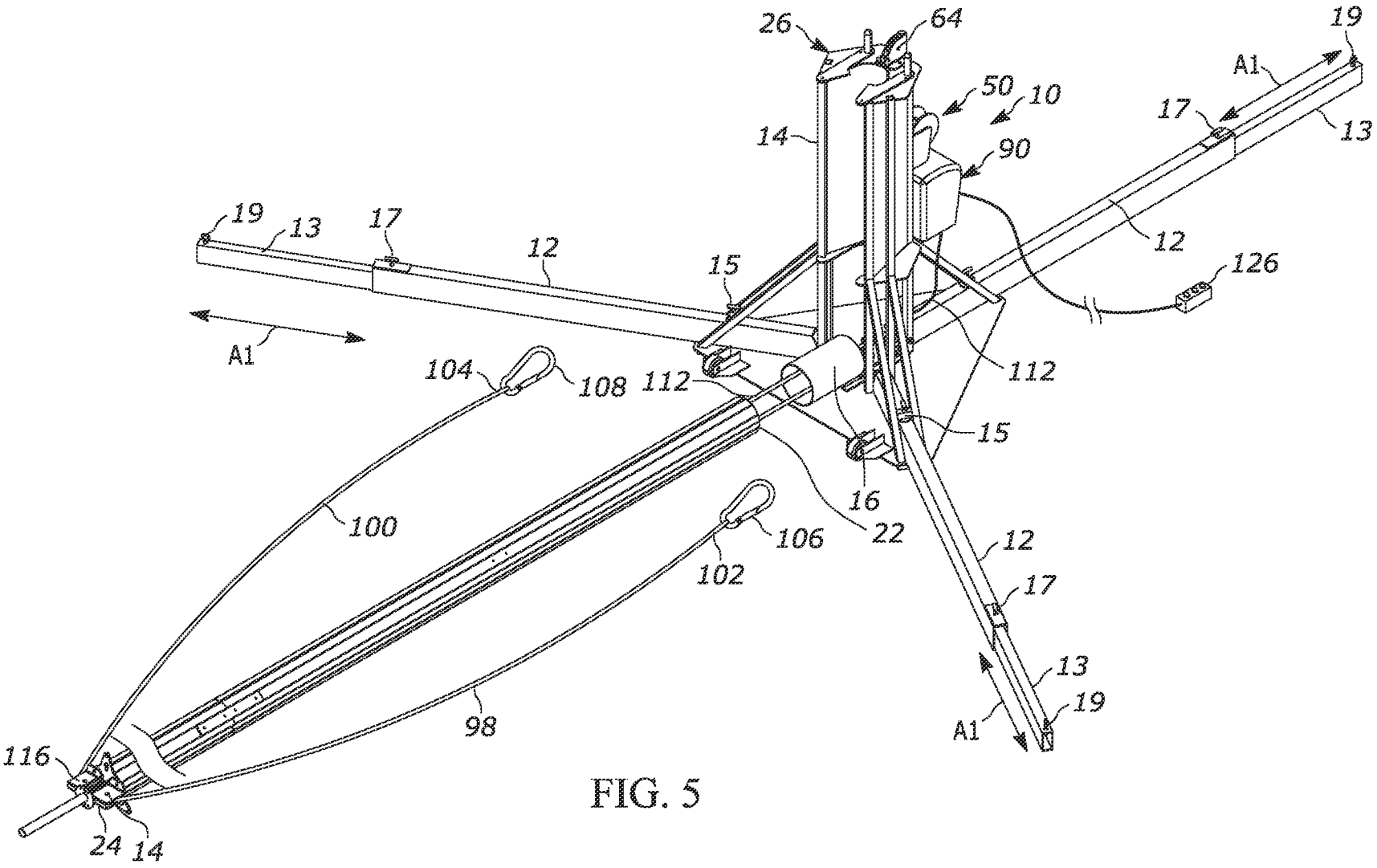
FIGS. 5-9 depict an example of a process for assembling and erecting an elongated support with respect to the base.

As shown in the example of FIG. 5, the base 10 includes a plurality of legs 12 extending outwardly from a central support structure 14 of the base. The legs 12 may be coupled to the base 10 by one or more fasteners 15 (e.g., nut and bolt, threaded locks, screws, clamps, and the like). While three legs 12 are shown in this example, different numbers of legs and/or different lengths may be used in other examples. The legs 12 are configured to provide additional stability after the base is positioned at the desired display location.

Figure 6:
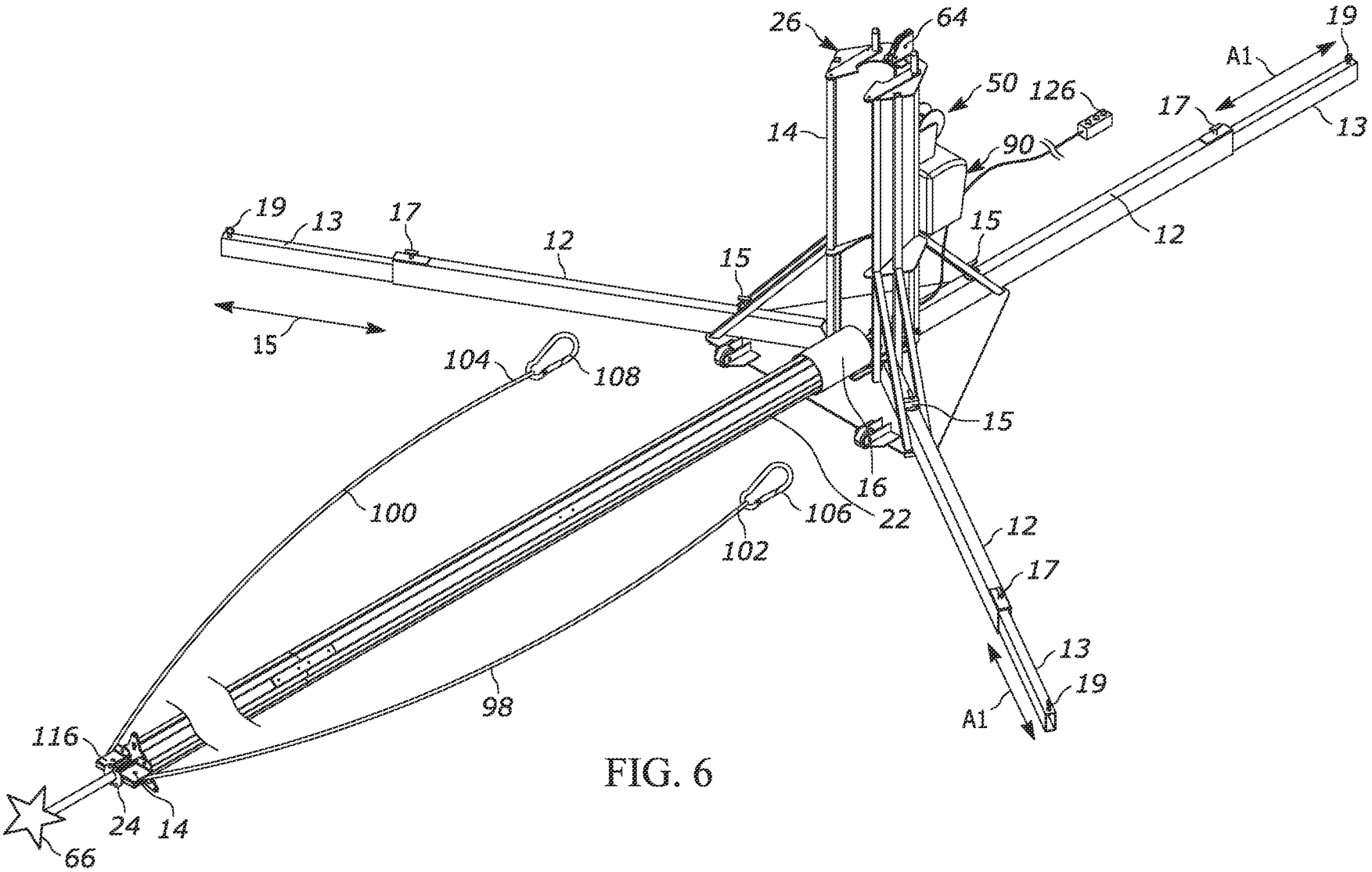

In some examples, the legs 12 may include telescoping leg portions 13 to provide adjustable lengths that may be set by a user. For example, the telescoping leg portions 13 may extend outwardly from the main part of the legs 12 and terminate in a respective distal end. As shown in the examples of FIGS. 5 and 6, the telescoping leg portions 13 are each moveable axially with respect to the respective legs 12 in the direction of arrow, shown as A1. FIGS. 1 and 2 show the legs 12, 13 detached from the central part of the base 10. That is, each of the main part of the legs 12 can be removable from and attachable to the base 10, and further can be omitted in some examples. For example, each leg 12 may include a respective fastener 17 adapted to fix the length of the telescoping leg portion 13 with respect to its main leg 12. For example, the fastener 17 can be implemented as a threaded T-bar lock, a bolt, a pin or another type of fastener configured to couple the legs 12 with respect to the base 10. As disclosed herein, the telescoping leg portions 13 are adapted to provide additional support and stability by increasing the diameter of the base 10, such as during assembly and/or disassembly of the tree 200.

Figure 17:
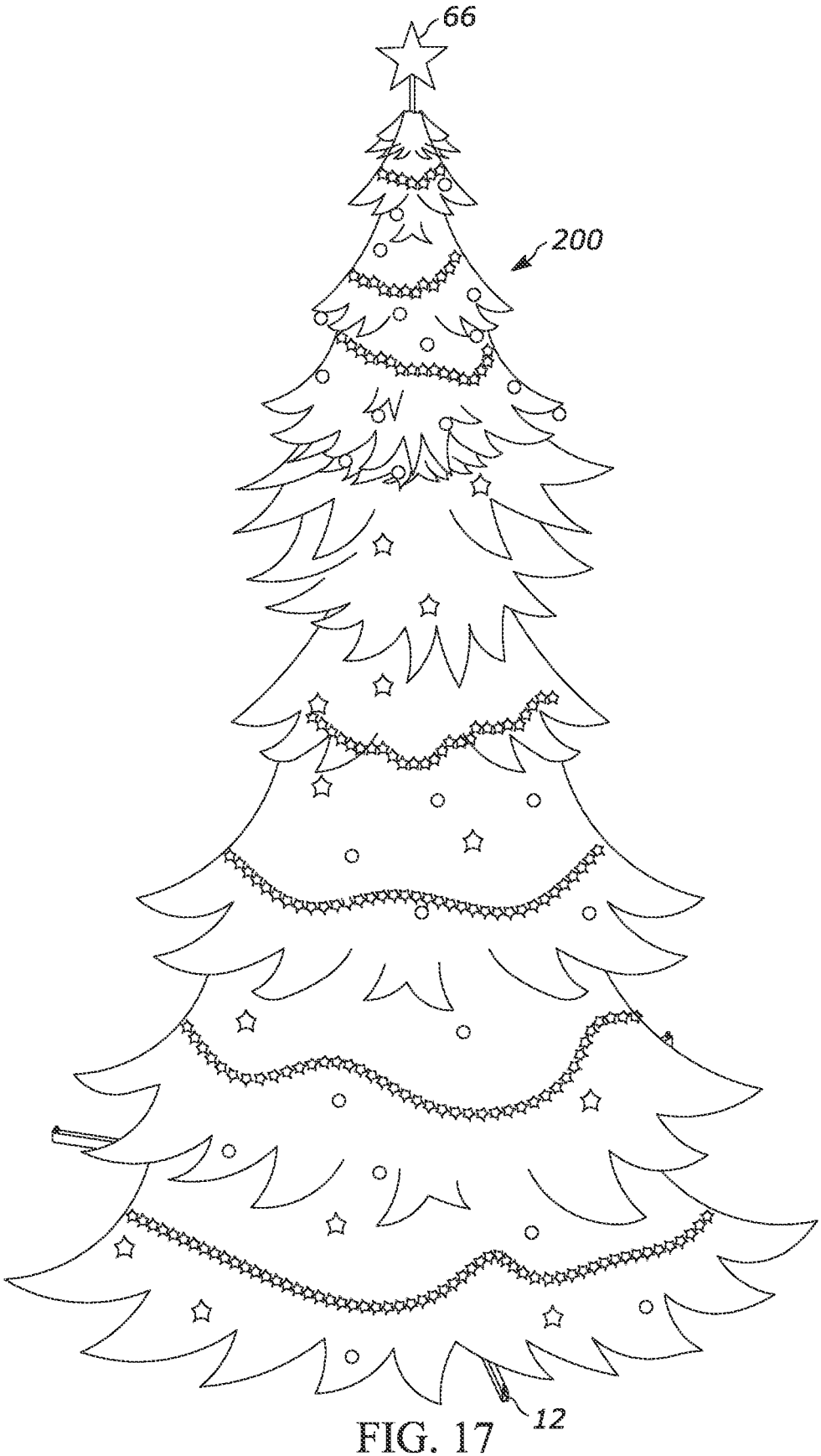
FIG. 17 depicts an example an assembled artificial Christmas tree.

As a further example, after assembly of the artificial Christmas tree 200 has been completed, the telescoping leg portions 13 can be inserted (e.g., fully or nearly fully) into respective main legs 12 as to reduce the diameter of the base to be commensurate with (or less than) the outer diameter of the branches at or near the bottom of the tree, such as the completed artificial Christmas tree 200 shown in FIG. 17. Alternatively, after assembly of the artificial Christmas tree 200, the telescoping leg portions 13 may be removed from the main legs 12 and stored until needed again. For instance, at a time for disassembly of the artificial Christmas tree 200, the telescoping leg portions 13 may be used again (e.g., re-inserted or pulled out from the main legs 12) to provide increased stability during the disassembly process.

Figure 3:
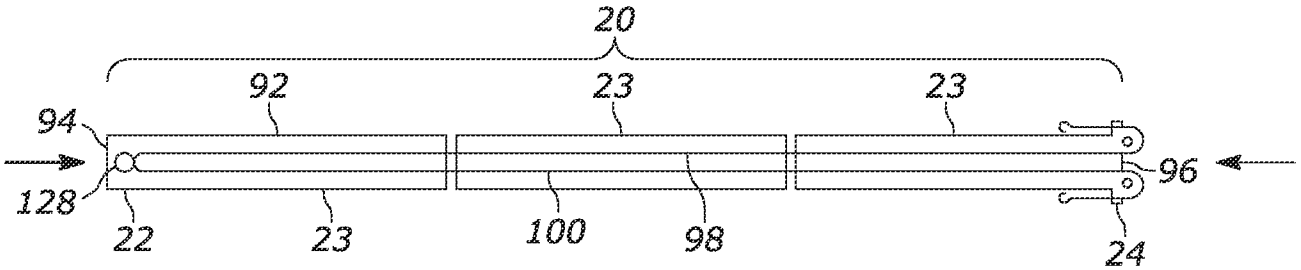
FIG. 3 depicts an example of an elongated support.

As shown in the example of FIGS. 3-9, the artificial tree 200 can include one or more elongated supports 20. The elongated support 20 has a proximal end portion 22 and an opposite distal end portion 24. The elongated support 20 can have a circular cross-sectional shape or another cross-sectional shape (e.g., rectangular, hexagonal or the like). The elongated support 20 can be formed of a rigid material, such as a metal, plastic, glass fiber, carbon fiber or the like. FIG. 3 depicts an example of the elongated support 20, in which the support includes multiple (e.g., two or more) elongated sections 23. The sections 23 are configured to be coupled together axially to provide the support having a desired length. For example, the support sections 23 can be coupled together by threaded fittings, friction fittings, welds, clamps, as well as other fittings or fasteners arranged and configured to couple the respective support sections together to form the elongated support 20. The use of multiple sections 23 enables a user to configure the same tree system to a number of different tree heights by selecting a subset of the support sections 23 with a corresponding set of frame sections designed to form an artificial Christmas tree having a desired height. For example, for each of a plurality of different possible support lengths, a given set of frame sections having respective shapes and lengths may be used to assemble a tree having the height commensurate with the selected support length. The same base 10 further may be used for any selected tree height. In other examples, a single monolithic pole may be used as the elongated support 20, and there can be a number of such poles for different height trees.

Figure 9:
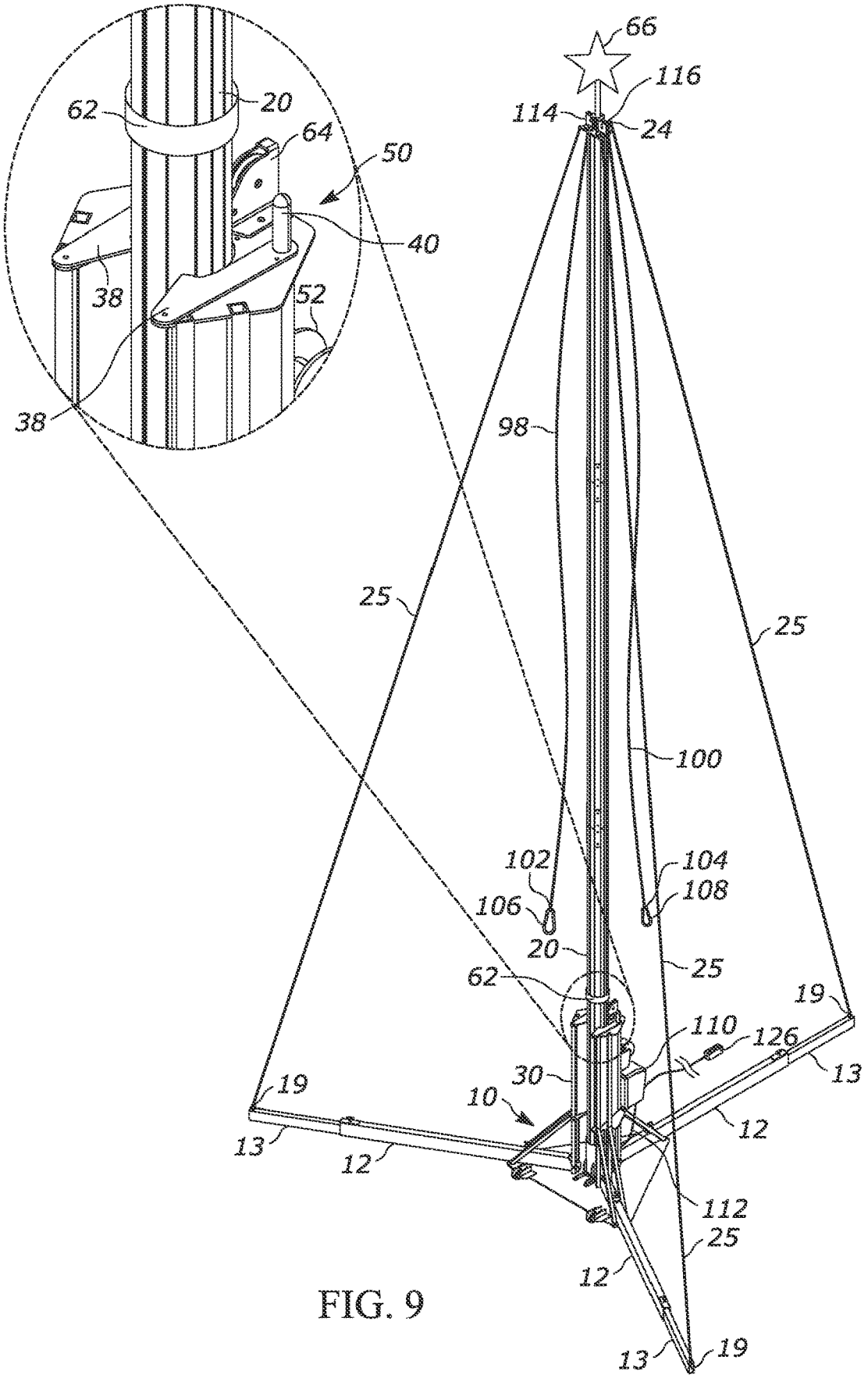

In some examples, one or more elongated flexible members (e.g., guy wires) may be coupled between a distal end portion 24 of the support 20 and ends of respective legs 12 or 13 to provide additional stability (e.g., during assembly and disassembly of the artificial Christmas tree). For example, as shown in FIG. 9, one or more elongated flexible members 25 can be implemented as guy wires extending between a distal end portion 24 of the support 20 to respective hooks (e.g., C-shaped or closed hooks) 19 located at end portions of telescoping leg portions 13. The elongated flexible members 25 can be implemented as wires, rope, cord, straps or elongated flexible members arranged and configured (e.g., as guy wires) to provide tension between the distal end portion 24 of the support 20 and the respective legs 12, 13. In other examples, guy wires could be coupled between the distal end portion 24 and the ground or other anchoring structure on or coupled to the ground.

In a further example, with reference back to FIG. 1, the artificial Christmas tree 200 includes a mounting post 16 coupled to the base 10. The mounting post 16 is moveable (in the direction of arrow A2) between a prone position (e.g., substantially parallel to the ground or more horizontal than vertical, as shown in FIG. 1) and an erect position (e.g., substantially orthogonal to the ground or more vertical than horizontal, as shown in FIG. 9). For example, the base 10 includes a coupling 18 configured to couple the mounting post 16 to the base 10 to enable the movement of the mounting post in the direction A2 between respective prone and erect positions. For example, the coupling 18 could be implemented as a joint, such as hinge, pivot joint, articulating joint, a track or other coupling arranged and configured to enable movement of the mounting post and elongated support 20 between prone and erect positions.

Figure 4:
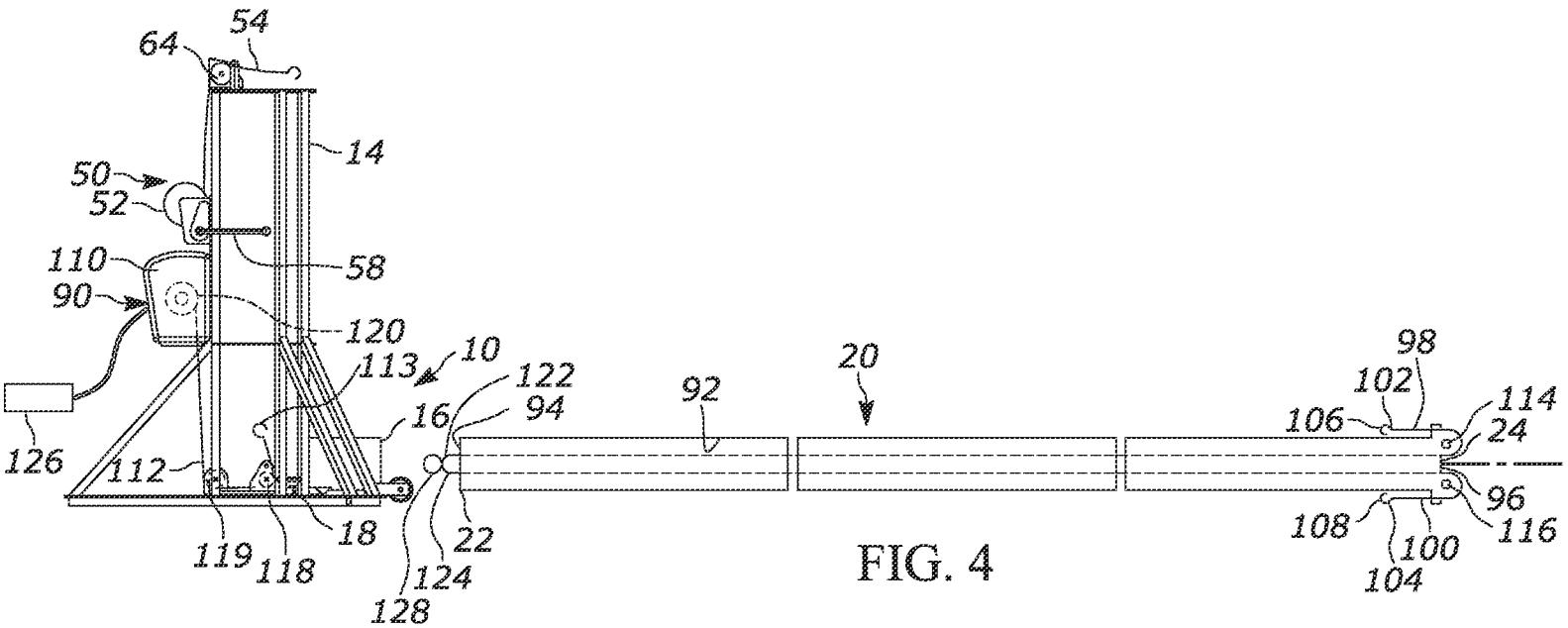
FIG. 4 is a side view of an elongated support and a base.

With reference to FIGS. 4 and 5, the mounting post 16 is adapted to couple to the proximal end portion 22 of the support 20, with the support and mounting post aligned in a substantially coaxial or parallel arrangement. In one example, the mounting post 16 includes a receptacle configured to receive the proximal end portion 22 of the support 20 within the receptacle. In another example, the proximal end of the support includes a receptacle that is configured to receive the mounting post 16 therein. Additionally or alternatively, the mounting post 16 may be coupled to proximal end portion 22 of the support using other means, such as mating threaded fittings, clips, clamps, hooks or other fasteners arranged and configured to couple the proximal end portion 22 and mounting post 16 together. In still other examples, the mounting post 16 may be omitted from the artificial Christmas tree 200, and the elongated support can be moved to its erect position manually (e.g., by hand).

In an example, the central support structure 14 of the base 10 includes a retainer 26 adapted to retain the support 20 in the erect position. For example, the base 10 includes a support bracket 30 extending between respective spaced apart proximal and distal ends 32 and 34. The proximal end 32 may be part of the central support structure. The retainer 26 may be located at or near the distal end 34 of the support bracket 30. The retainer 26 may be implemented as a fastener, frame, bracket, enclosure, cage or guide arranged and configured to retain the support 20 in the erect position relative to the base 10. For example, the support bracket 30 is implemented as a rigid cage or bracket extending upwardly from the proximal end 32, which is fixed to the central portion 11 of the base 10. The support bracket 30 has an opening 36 along one side of the support bracket, and the opening is arranged and configured to receive the mounting post 16 and the proximal end portion 22 of the support 20 therein while in the erect position. As shown in the example of FIGS. 1 and 2, the support bracket 30 and retainer 26 share the opening 36 along a common side of the support bracket. The retainer 26 thus may hold the mounting post 16 and/or the support 20 in the erect position with respect to the support bracket 30 when moved to the erect position, such as shown in FIG. 9.

As a further example, the retainer 26 includes a latch 38 adapted to hold the support 20 in the erect position. The latch 38 may be implemented as a locking mechanism, pin, pawl, clamp or any other structure arranged and configured to hold the support 20 in the erect position with respect to the base 10. For example, the latch 38 includes spaced apart retaining arms that are mechanically biased (e.g., by springs) toward each other and include shoulder portions configured to snap-fit and lock the elongated support 20 when moved to the erect position. The retainer 26 can also include an actuator 40 adapted to release the support 20 from being held by the latch 38, such as by moving the spaced apart arms of the latch away from each other. For example, responsive to movement of actuator 40 from a lock position to a release position, retaining arms of the latch 38 are moved away from the each other to enlarge the opening 36. Thus, when the actuator 40 is in the release position, the latch 38 is configured to allow the support 20 to move through the opening 36 between the erect position (e.g., upright orientation within the support bracket 30) and the prone position (e.g., on the ground or other surface).

As described herein, the support 20 can be moved between its prone and erect positions manually or in a mechanically assisted manner. An example of a manual approach to move the support is one or more persons applying physical force to guide the support 20 and/or mounting post 16 (e.g., using their hands without mechanical or powered assistance) from the prone position to the erect position or from the erect position to the prone position. The manual approach may be implemented while the proximal end of the support is coupled to the mounting post, as described herein, as well as in the absence of a mounting post. An example of a mechanically-assisted approach to move the support 20 includes use of a hoist 50 configured to apply a physical force to move (or help move) the support between respective prone and erect positions.

For example, with reference to FIGS. 2 and 7-9, the artificial Christmas tree 200 includes a hoist 50. The hoist 50 can be coupled to the base 10 and/or the support 20. The hoist 50 is adapted to move the support 20 between the prone and erect positions, as described herein. In an example, the hoist 50 includes a winch 52 and a flexible elongated member 54. The flexible elongated member 54 can be implemented as a rope, a cord, wire or a cable or other flexible member having sufficient flexibility and tensile strength to support the weight of the elongated support 20 as it is moved between prone and erect positions by the winch 52.

In an example, the winch 52 is coupled to the base 10, such as attached to the support bracket 30. In other examples, the winch 52 can be coupled to other parts of the base 10. As an example, the winch 52 can be implemented as a mechanical winch (e.g., hand winch) that includes a spool 56 and a crank 58, such as shown in FIG. 2. In another example, the winch 52 may be implemented as a powered winch (e.g., powered by electric, hydraulic, pneumatic and/or another drive mechanism) in which the rotation of the spool 56 is driven in response to user-actuation of a control button or switch. The direction in which the spool 56 is rotated about an axis thereof controls whether the flexible elongated member 54 is being wound onto the spool 56 (to decrease the length of the flexible elongated member) or is unwound from the spool 56 (to increase the length of the flexible elongated member).

Figure 7:
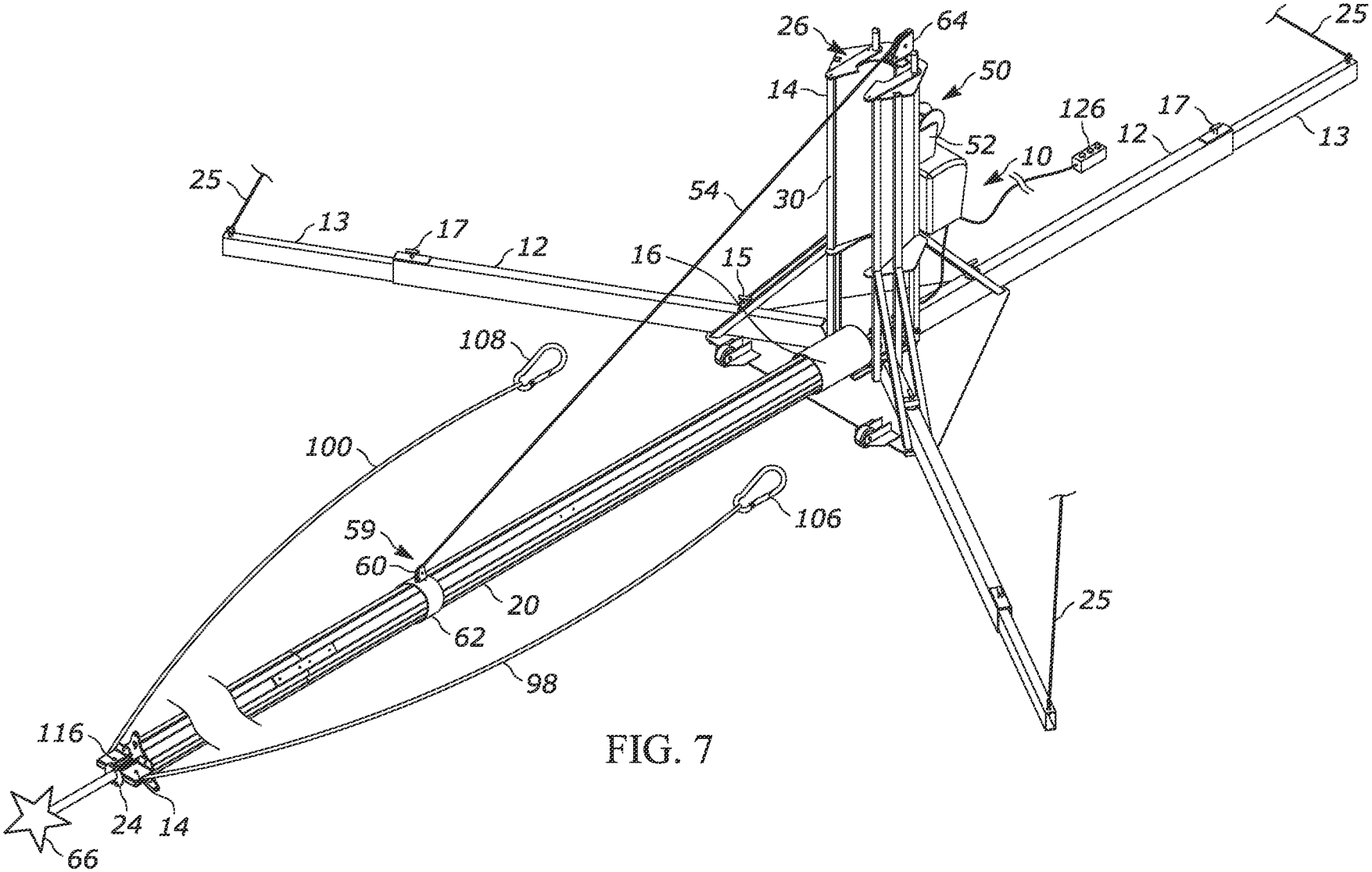
Figure 8:
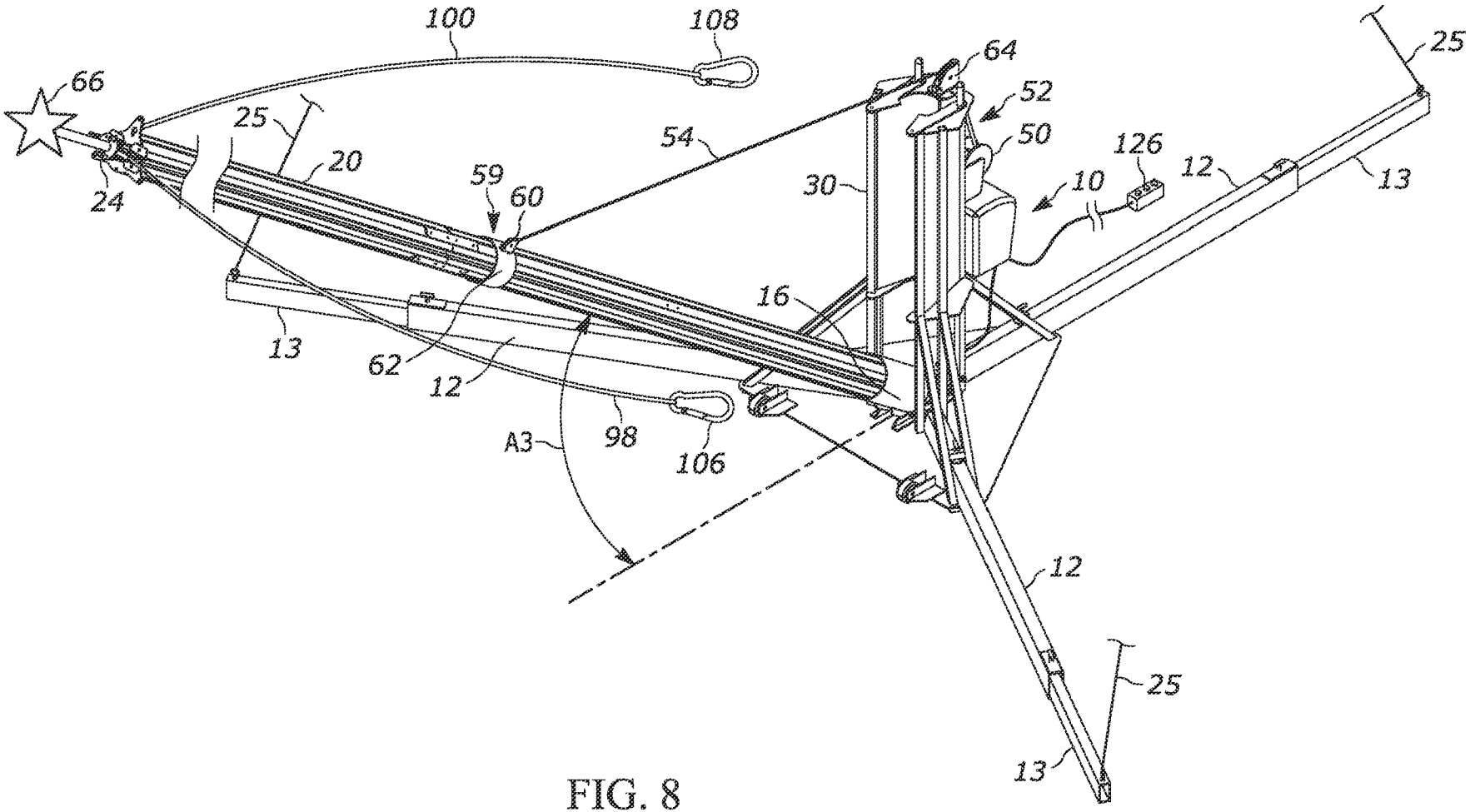

For example, as shown in FIGS. 7 and 8, the flexible elongated member 54 extends from the winch 52 and is coupled to the support 20 at an intermediate location 59 of the support between its proximal and distal end portions 22 and 24. The intermediate location 59 may be spaced from the proximal end portion 22 of the support a distance that is approximately equal to (though it may be more or less than) a height of the support bracket 30. Thus, when the support 20 is in the erect position and retained within the support bracket 30, such as shown in FIG. 9, the location 59 is adjacent but spaced away from (e.g., above) the distal end 34 of the support bracket 30, and the latch 38. A connector 60 can be coupled to support 20 at the intermediate location 59 of the support 20. In the examples shown in FIGS. 7 and 8, a collar 62 is coupled around (partially or entirely around) the support 20 at the intermediate location 59, and the collar 62 includes the connector 60. The collar can be implemented as a strap, a sleeve, a clamp or other structure that may be permanently or removably coupled to the support to hold the connector 60 at the location 59. In another example, the connector 60 can be coupled directly to the support 20 at the intermediate location 59, such as by a mechanical fastener (e.g., nut and bolt, screw, rivet, etc.), adhesive bond, weld or the like. Thus, the connector 60 may be permanently coupled to the support 20 or be removable from the support. In yet another example, the flexible elongated member 54 is coupled to the support 20 at the intermediate location without the connector 60, such as by looping a free end portion of the flexible elongated member 54 around the support 20 and attaching the free end portion with another part of the flexible elongated member 54 at the location 59.

By way of further example, the hoist 50 can also include an arrangement of one or more pulleys 64 that can be coupled to the base 10, such as at or near the distal end 34 of the support bracket 30. The pulley 64 thus can be configured to support movement and change of direction of the flexible elongated member 54 between the winch 52 and the location 59 (e.g., connector 60) where the flexible elongated member 54 is coupled to the support 20. As mentioned, the winch 52 is adapted to change the length of the flexible elongated member 54 between the winch 52 and the support 20 to thereby move the support between the prone and erect positions, as shown in FIGS. 7-9. While in the examples disclosed herein, the hoist 50 includes the winch 52, in other examples, the winch 52 may be omitted from the hoist, and hoist include the flexible elongated member 54 and/or the arrangement of one or more pulleys 64. In such example, the flexible elongated member 54 can be manually or otherwise pulled through one or more pulleys 64 to move the support 20 to a desired position. One or more rollers can also be used to facilitate movement of the flexible elongated member 54 relative to the support 20. After being moved to the erect position, the support 20 can be fixed in place, such as by tying or otherwise securing the flexible member 54 with respect to the base 10.

In some examples, one or more tree topper 66 may be attached at the distal end portion 24 of the support 20. For example, prior to moving the support 20 to the erect position, the tree topper can be coupled at the distal end portion 24, as shown in FIG. 6. The coupling may further be configured to provide electrical power to the tree topper 66 and/or other associated decorations. For example, the topper 66 includes a tree topper (e.g., a star, angel or other ornamental topper). Additionally, or alternatively, the topper 66 can include a top set of respective tree branches with needles and having a general conical shape arranged and configured to form a continuous tree when a top tree frame section (e.g., to which branches have already been coupled) is hoisted longitudinally to its final assembly position at or near the distal end portion 24 of the support, as disclosed herein (see, e.g., FIG. 17). Respective branches may be coupled at the top of the support 20 separately or may be an integrated set of top branches for the artificial Christmas tree.

The artificial Christmas tree 200 includes a plurality of frame sections 70, 130, 140 and 150 adapted to be assembled to form a tree frame 72, such as shown in FIGS. 10-16. When assembled, each of the frame sections 70, 130, 140 and 150 can have a shape that is cylindrical, frusto-conical or a frame section may include a combination of cylindrical and frusto-conical portions. Thus, when the frames sections are coupled together, as disclosed herein, they form a tree frame for the artificial Christmas tree 200, so that the tree can have a generally conical shape, such as the artificial Christmas tree shown in FIG. 17. However, because the frame sections are separate, the systems and methods disclosed herein can be used to form an artificial Christmas tree having virtually any shape or combinations of shapes, including cylindrical, conical, ellipsoidal, polyhedral, spherical and semi-spherical to name a few.

In the examples of FIGS. 10-16, the frame sections 70 are moveable in the longitudinal direction above the assembly location, such as along the length of the support 20. For example, a given frame section 70 has proximal and distal ends 74 and 76 spaced longitudinally apart from each other. The proximal end 74 of a given frame section 70 is adapted to be coupled to a distal end 76 of another frame section. In this way, longitudinal movement of the given frame section 70 along the support 20 causes corresponding axial movement of each other frame section (e.g., frame sections 130, 140 and/or 150) to which the given frame section is coupled.

Figure 10:
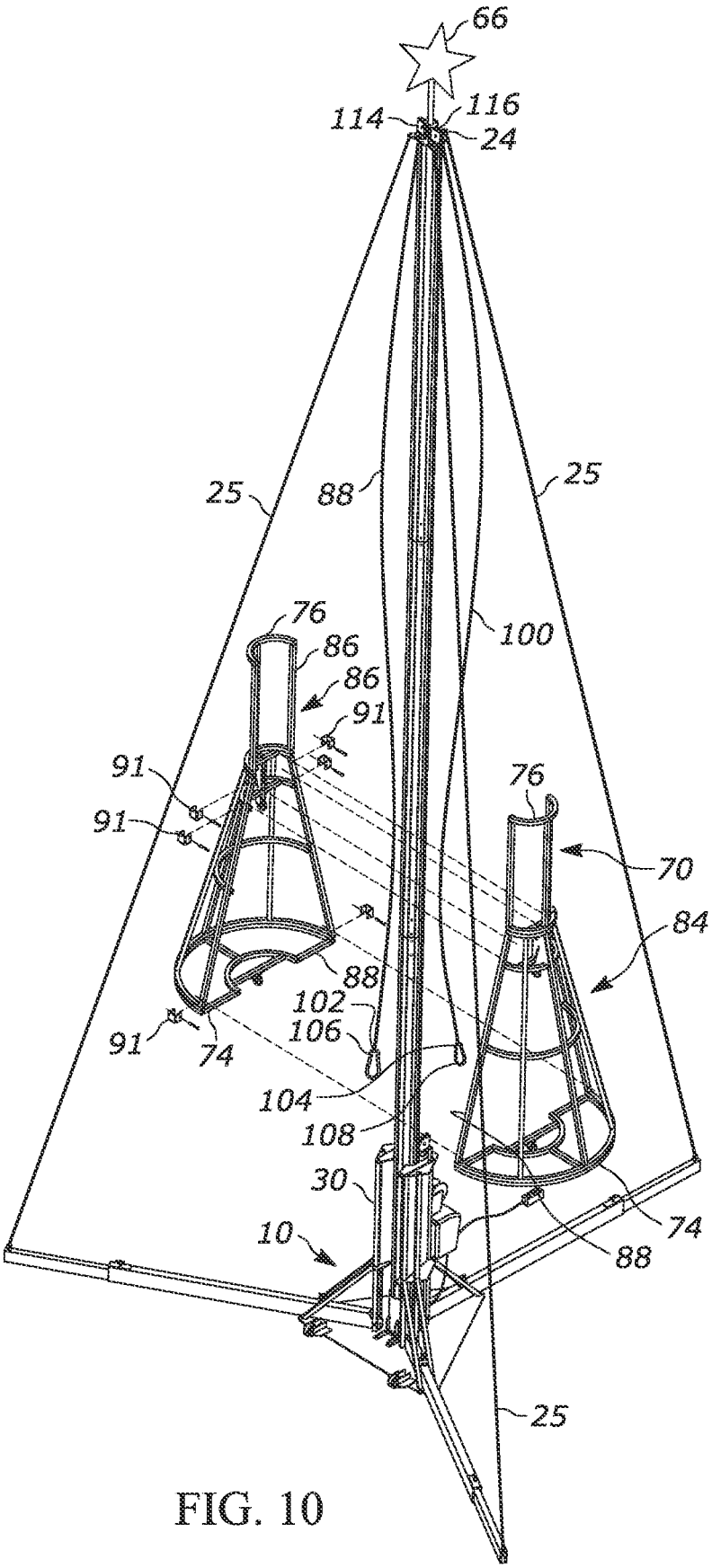
FIGS. 10-16 depict an example of a process for assembling frame sections of an artificial Christmas tree.
Figure 11:
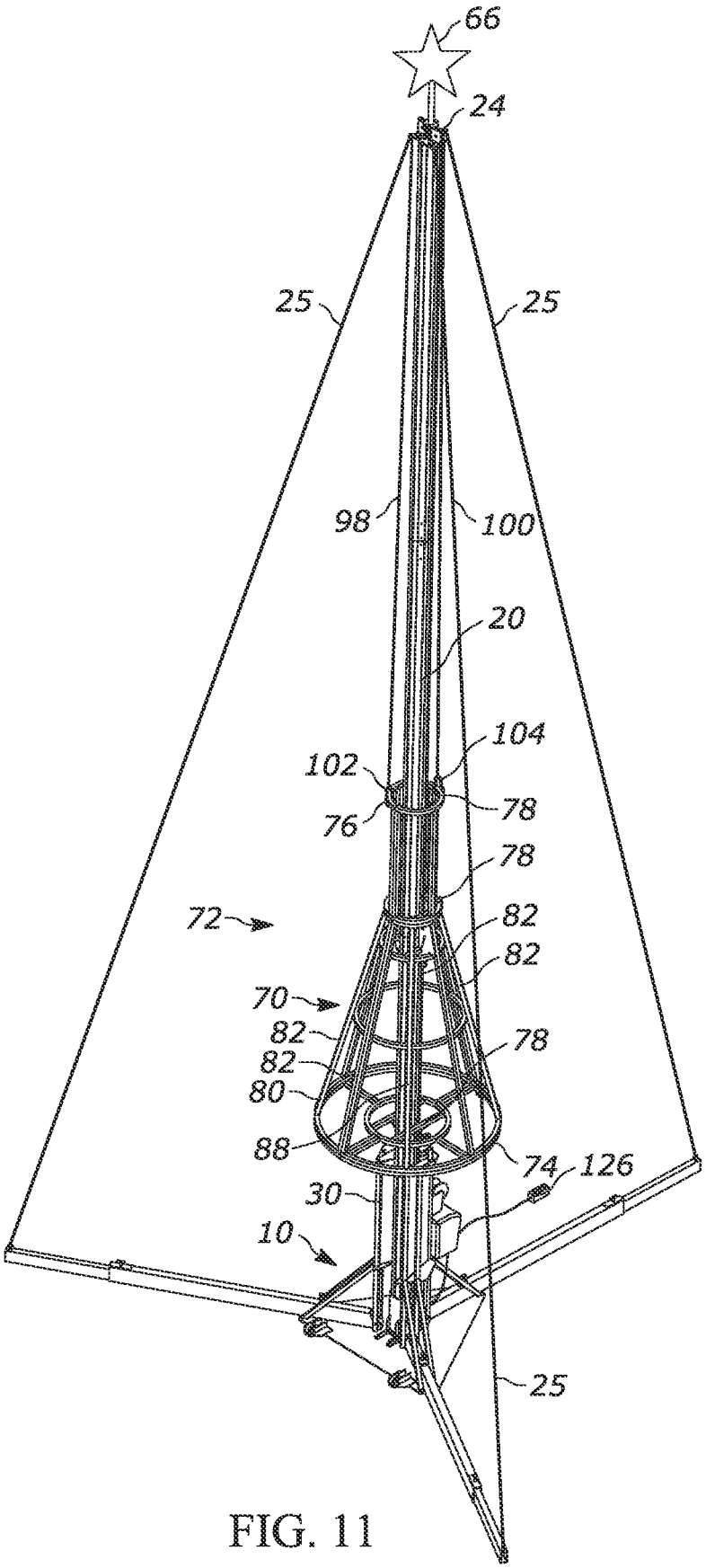

As shown in the example of FIGS. 10 and 11, the frame section 70 includes one or more annular brackets (e.g., a collar portion) 78 configured to surround the support 20. The annular brackets 78 has an inner diameter that at least approximates an outer diameter of the support 20. A radially outer portion 80 of the frame section 70 has an inner diameter that is greater than the inner diameter of the annular brackets 78. One or more braces 82 extend between the annular brackets 78 and the radially outer portion 80 of the respective frame section 70.

As shown in the example of FIG. 10, to facilitate coupling respective frame sections 70 around the erect support, each respective frame section includes two or more annular sector portions 84 and 86 configured to be coupled together around the support 20. An abutment, demonstrated at 88, between the respective sector portions 84 and 86 can extend longitudinally between the axially spaced apart ends 74 and 76 of the frame section 70. The two annular sector portions 84 and 86 may be coupled together along each abutment 88 by fasteners 91 arranged and configured to mechanically join the annular section portions together, such as shown in FIGS. 10 and 11. Examples of fasteners 91 that may be used, individually or in combination, include nuts and bolts, locking pins, tape, zip ties, magnetic couplings, Velcro, or other fasteners arranged and configured to join the sector portions 84 and 86 together.

By way of further example, a sum of angles that the annular sector portions 84 and 86 of each respective frame section 70, 130, 140, 150 span is 360 degrees so as to circumscribe the elongated support 20. In the example of FIGS. 10-11, the frame section 70 includes two annular sector portions 84 and 86 that each spans an equal angle, such as approximately 180 degrees. In other examples, the annular sector portions for a respective frame section may be asymmetric, in which the angles that each annular sector portion spans are different from each other. Additionally, while the example frame sections 70 and 130 shown in FIGS. 10-11 includes two annular sector portions, one or more other frame sections 140 and 150 can include more than two annular sector portions (e.g., 3, 4, 5 or more annular sector portions), each of which may span the same or different angles. The number of annular sector portions in a respective frame section can depend on the outer diameter of the frame section. For example, larger diameter frame sections (e.g., lower frame sections) that are closer to the surface on which the base 10 is placed may have a larger number of annular sector portions than smaller diameter frame sections(e.g., upper frame sections) that are further from the surface on which the base 10 is placed. The number of annular sector portions for a given frame section 70 thus may further be designed to facilitate storage and/or transport.

As a further example, with reference back to FIGS. 2 and 4, the artificial Christmas tree 200 can include an additional hoist 90 coupled to the base 10, such as at or near the lower end 32 of the support bracket 30. The hoist 90 can also be coupled to one or more frame sections and adapted to move one or more of the frame sections along the support 20 in a longitudinal direction of the tree frame 72 above an assembly location. The hoist 90 can be implemented as including any device or combination of devices, including manually operated, electrically and/or pneumatically driven hoists, configured and arranged to move respective frame sections 70, 130, 140, 150 longitudinally above the assembly location. In one example, the hoist 90 also includes a connecting element that extends from a distal end of the support 20 that is configured to couple to and move the respective frame sections 70, 130, 140, 150 longitudinally above the assembly location along the support 20 (e.g., by hoisting from above). In another example, the hoist is configured to lift the respective frame sections 70, 130, 140, 150 from below (see, e.g., FIGS. 22-24). In an example, the hoist 90 is separate from the hoist 50 that is adapted to move the support between its prone and erect positions. In another example, the hoist 90 may use some of the same parts as the hoist 50.

As described herein, the artificial Christmas tree 200 and related methods allow a user to attach tree features to respective frame section of the tree without requiring the use of ladders or other specialized equipment. The tree frame 72, as formed by respective frame sections 70, 130, 140 and 150, has an outer frame portion adapted to support artificial tree features 83. The artificial tree features 83 can include branches, ornaments, lights and/or other decorations. Some or all the ornaments, lights and other decorations may be coupled to respective branches before the branches are attached to the respective frame sections 70. Alternatively, some or all of the ornaments, lights and other decorations can be coupled to the branches during assembly of the artificial Christmas tree, such as after the branches are attached to the respective frame sections 70.

Figure 12:
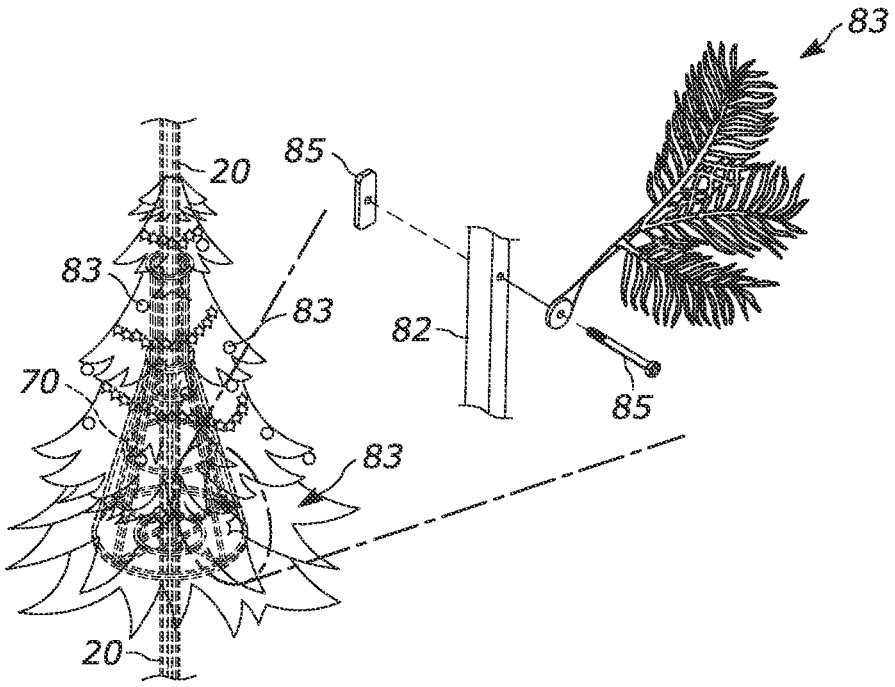

As shown in the example of FIG. 12, tree features 83 can include branches with an arrangement of artificial foliage (e.g., needles or other leaves), ornaments, lights and other decorations. Such tree features 83 can be coupled to a respective frame section 70, 130, 140, 150 prior to hoisting the frame section longitudinally towards the distal end portion 24 of the support 20. For example, the hoist 90 can be used to position the frame section at desired height along the support to facilitate coupling tree features 83 to respective frame sections. In the example of FIG. 12, tree features 83 are coupled to the frame braces 82 by fasteners 85 after frame section 70 has been coupled to the support 20. The fasteners 85 can be implemented as nuts and bolts, screws, pins, ties, and/or other fasteners arranged and configured to couple respective tree features to the frame sections. In some examples, some or all tree features 83 could be coupled to the frame section even before the frame section has been coupled around the support.

In some examples, the elongated support 20 can include one or more guides extending longitudinally along the support 20. The one or more guides (e.g., passages) are configured to enable movement of one or more flexible elongated members 98, 100 and/or electrical wires through or along the support 20 to facilitate operation of the hoist 90, such as disclosed herein. For example, an electrical wire can be coupled between the tree topper 66 and extend through the guides to a source of electrical power. In another example, there can be one guide for each of the flexible elongated members 98, 100, or a respective guide may be shared by the flexible elongated members 98, 100. For example, the support 20 is hollow and thus has a passage (e.g., lumen) 92 extending longitudinally through the support to define the respective guide. The passage 92 has openings 94 and 96 at or near each of the respective proximal and distal end portions 22 and 24 of the support 20. The guide passage 92 can have an internal diameter sufficient to receive one or more of flexible elongated members and/or other members (e.g., electrical connectors, conduits, etc.) within the passage.

The flexible elongated members 98, 100, which can form part of the hoist, can be implemented as ropes, cords, wires, cables or other flexible member having sufficient flexibility and tensile strength to support the weight of the frame sections as they are moved along the support 20 by the hoist 90. While two flexible elongated members 98, 100 are shown in the examples of FIGS. 4-13, different numbers (e.g., a greater or lesser number than two) of flexible elongated members can be used in other examples as part of the hoist 90

As shown in the example of FIGS. 9 and 10, a portion of each of the flexible elongated members 98, 100 extends from the distal end portion 24 of the support 20 to terminate in a respective end 102, 104. The ends 102, 104 can include respective connectors 106, 108 configured to couple the flexible elongated members 98, 100 to one or more frame sections 70, such as for hoisting respective frame sections along the support, such as disclosed herein (see, e.g., FIGS. 11-16). In other examples, namely where a brake apparatus has been included within a given frame section 70, the connector ends may be coupled to the brake (see, e.g., FIGS. 18-20). Another portion of the flexible elongated members 98, 100 may extend into and through the support 20. The hoist 90 is configured to adjust the length of the flexible elongated members 98, 100 that extends from the distal end portion 24 of the support 20 to control the position of one or more frame sections along the support 20.

As a further example, with reference to FIGS. 2 and 4, the hoist 90 can include a winch 110, the flexible elongated members 98, 100, another flexible elongated member 112 and an arrangement of pulleys 114, 116, 118 and 119. The winch 110 is coupled to the base 10, such as coupled to the support bracket 30. The pulleys 114 and 116 are coupled to the support 20 near the opening 96 at the distal end portion 24 of the support 20. For example, the pulleys 114 and 116 may be mounted at diametrically opposed sides at the distal end portion 24 and configured to help keep the end connectors and flexible elongated members 98, 100 separated along opposing exterior sides of the support 20. While two pulleys 114 and 116 and associated flexible elongated members 98, 100 are shown, any number of one or more flexible elongated members and respective pulleys could be used in other examples. The pulley 118 is coupled to the central portion of the base 10 and aligned with the opening 94 near the proximal end portion 22 of the support 20 when the support is retained (e.g., by retainer 26) in the erect position. The pulley 119 is also coupled to the base 10, such as aligned with the winch 110. For example, the pulleys 118 and 119 are configured to support movement and change of direction of the flexible elongated member 112 between the support 20 and the winch 110.

As shown in FIG. 4, the winch 110 includes a spool 120 that rotates in a respective direction to control winding or unwinding a length of the flexible elongated member 112 from the spool. For example, the flexible elongated member 112 extends from the spool 120 of the winch 110, passes over pulleys 118 and 119, and is coupled to the flexible elongated members 98, 100. For example, a distal end 113 of the flexible elongated member 112 is coupled to respective ends proximal 122, 124 of the flexible elongated members 98, 100 (e.g., within passage 92 of the support 20). In another example, the flexible elongated members 98, 100 can be a formed of a single length of the flexible elongated member, and the distal end of the flexible elongated member 112 is coupled to a midpoint (at the location of ends 122 and 124) of the flexible elongated member, such as by connector 128.

The winch 110 may be a manual winch or a powered winch, such as described herein. In the example of FIGS. 1-14, the winch 110 is shown as an electrically-powered winch configured to control the rotation of the spool 120 in response to user-actuation of a control button or switch of a control device 126. The use of an electrically powered winch 110 facilitates hoisting the frame sections longitudinally along the support, and further allows a user to continuously or intermittently adjust the height of respective frame sections while adding and/or removing tree features 83. In an example, the control device 126 can be a remote control device that is physically or wirelessly coupled to a drive mechanism for controlling the rotation of the spool 120. While the hoist 90 is shown in FIGS. 1, 2 and 4-16 to include the winch 110 to adjust the longitudinal position of the frame sections 70, in other examples, the winch could be omitted from the hoist 90. The longitudinal position of the frame sections 70 thus could be adjusted manually (e.g., by hand) along the support 20 without use of a winch, and one or more flexible elongated members could be secured (e.g., with respect to the base 10) to hold the length at a desired position during assembly and disassembly of the artificial Christmas tree, including when attaching and removing tree features 83.

By way of further example, the continued assembly of the artificial Christmas tree 200 is disclosed with reference to FIGS. 10-16. For example, after some or all respective tree features 83 have been coupled to the first frame section 70, the first frame section 70 is moved longitudinally along the support 20 toward the distal end portion 24 of the support. For example, the hoist 90 is used to move the frame section 70 above the legs 12, 13 by an amount sufficient to place a next frame section 130 beneath the frame section 70 (e.g., in a space between the legs of the base and the proximal end 74)

Figure 13:
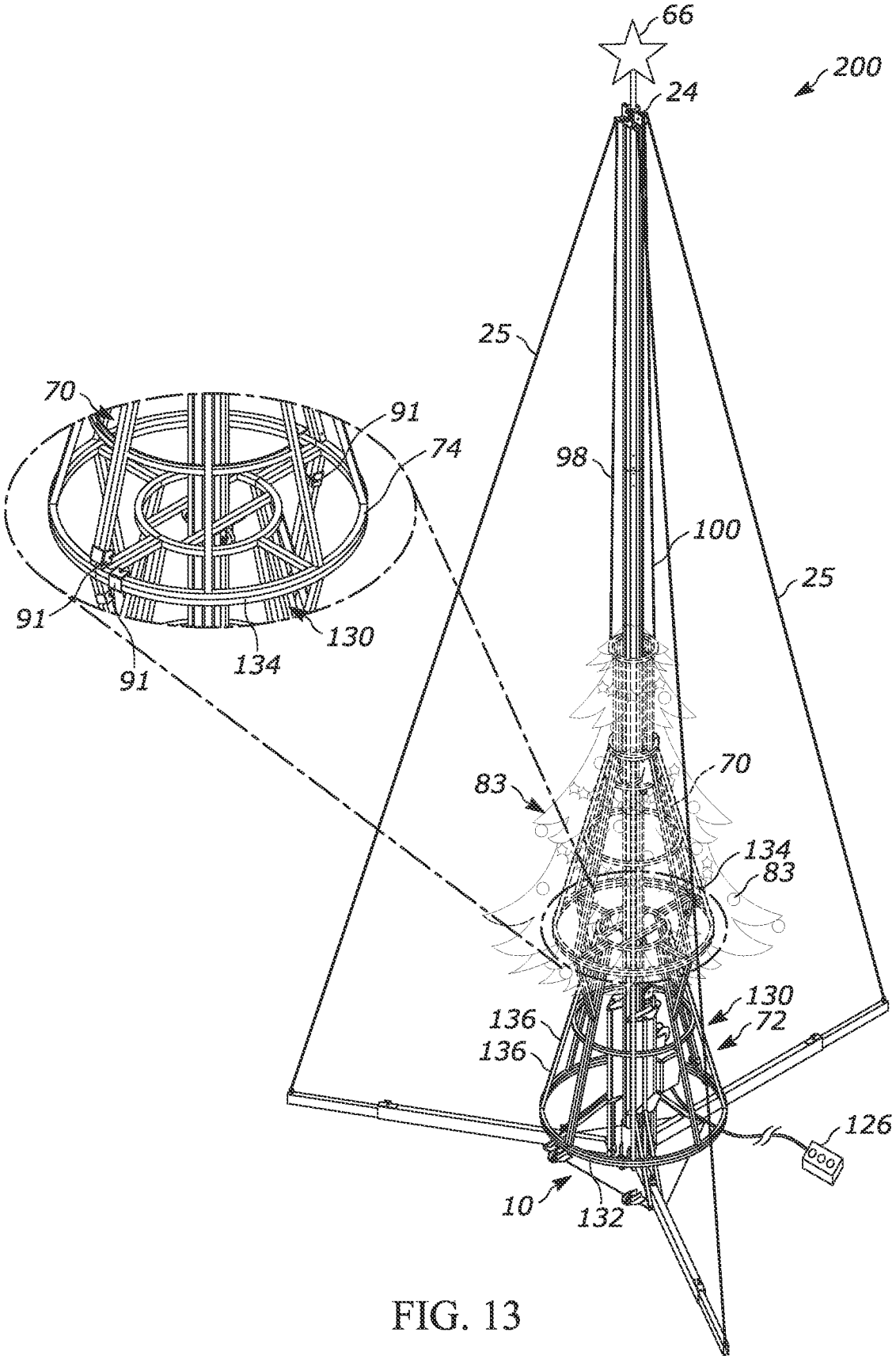

A next frame section 130 is coupled around the support 20 beneath the preceding frame section 70 (e.g., between the legs of the base and first frame section 70. The frame section 130 may include two or more annular frame sectors, such as described with respect to FIG. 10. For example, the frame section 130 includes two annular sectors that each spans 180 degrees. The frame sectors of the frame section 130 are coupled together by fasteners around the support below the frame section 70, such as described herein with respect to frame section 70. In the example of FIG. 13, the frame section 130 is in the shape of a conical frustum having spaced apart proximal and distal ends 132 and 134 and longitudinally extending braces 136 between the ends. The distal end 134 has a smaller diameter than the proximal end 132. The distal end 134 has the same diameter and is configured to abut the proximal end 74 of the preceding frame section 70 to facilitate connecting the frame sections 70 and 130 together.

Figure 14:
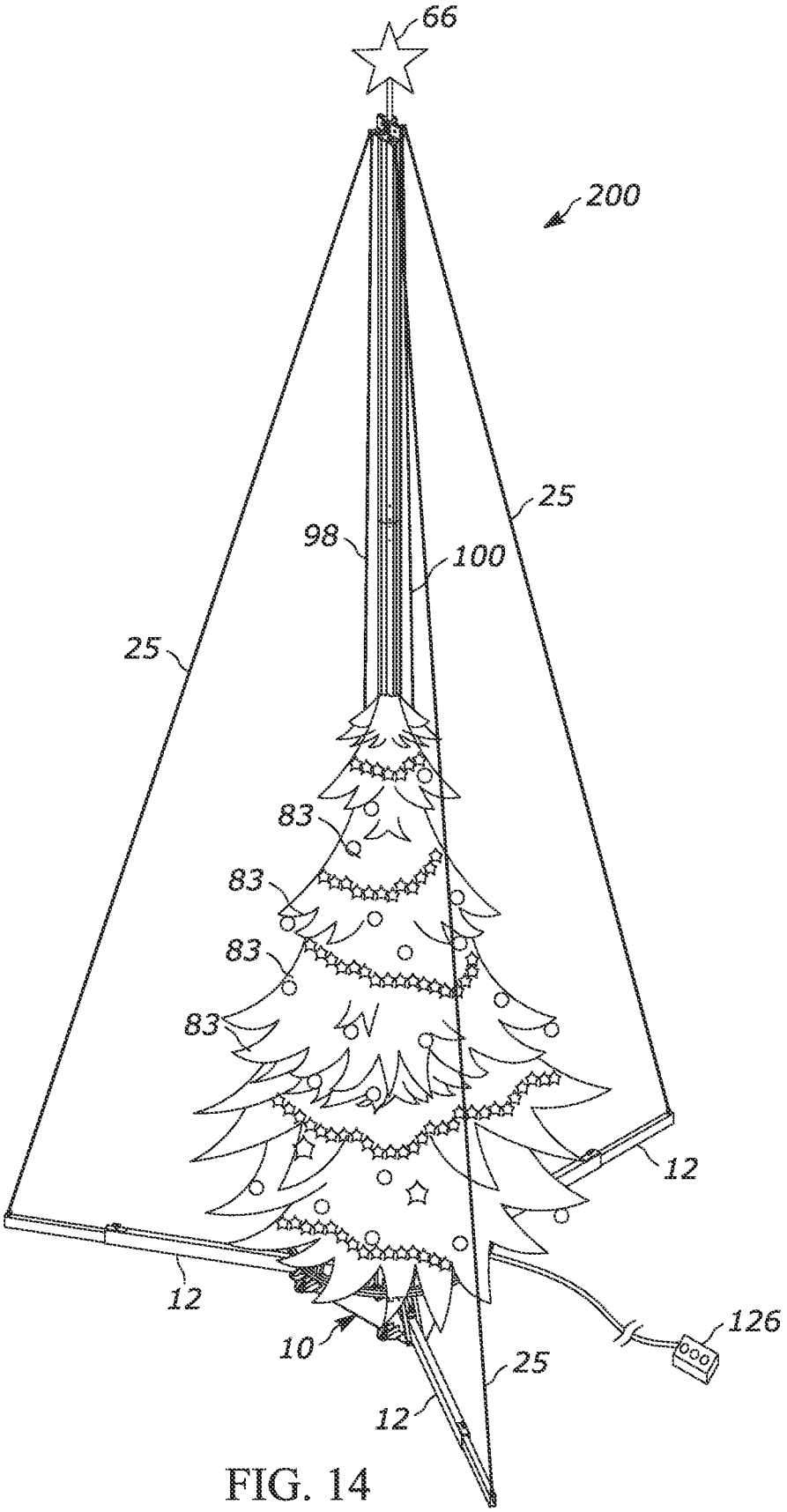

For example, the distal end 134 of the frame section is coupled to the proximal end 74 of the preceding frame section 70 by fasteners 91 arranged and configured to mechanically join the respective frame sections together, such as shown in FIG. 13. Examples of fasteners 91 that may be used to couple frame sections 70 and 130 together include one or more of nuts and bolts, locking pins, tape, zip ties, magnetic couplings, Velcro, or other fasteners arranged and configured to join the frame sectors 84 and 86 together. The type of fasteners 91 further may be selected according to expected loads to be experienced by the respective fasteners, which may vary depending on wherein the tree assembly the fasteners are used. Tree features 83 can be coupled to the braces of the frame section 130, such as disclosed with respect to FIG. 12 to form a partially assembled artificial Christmas tree, as shown in FIG. 14.

Figure 15:
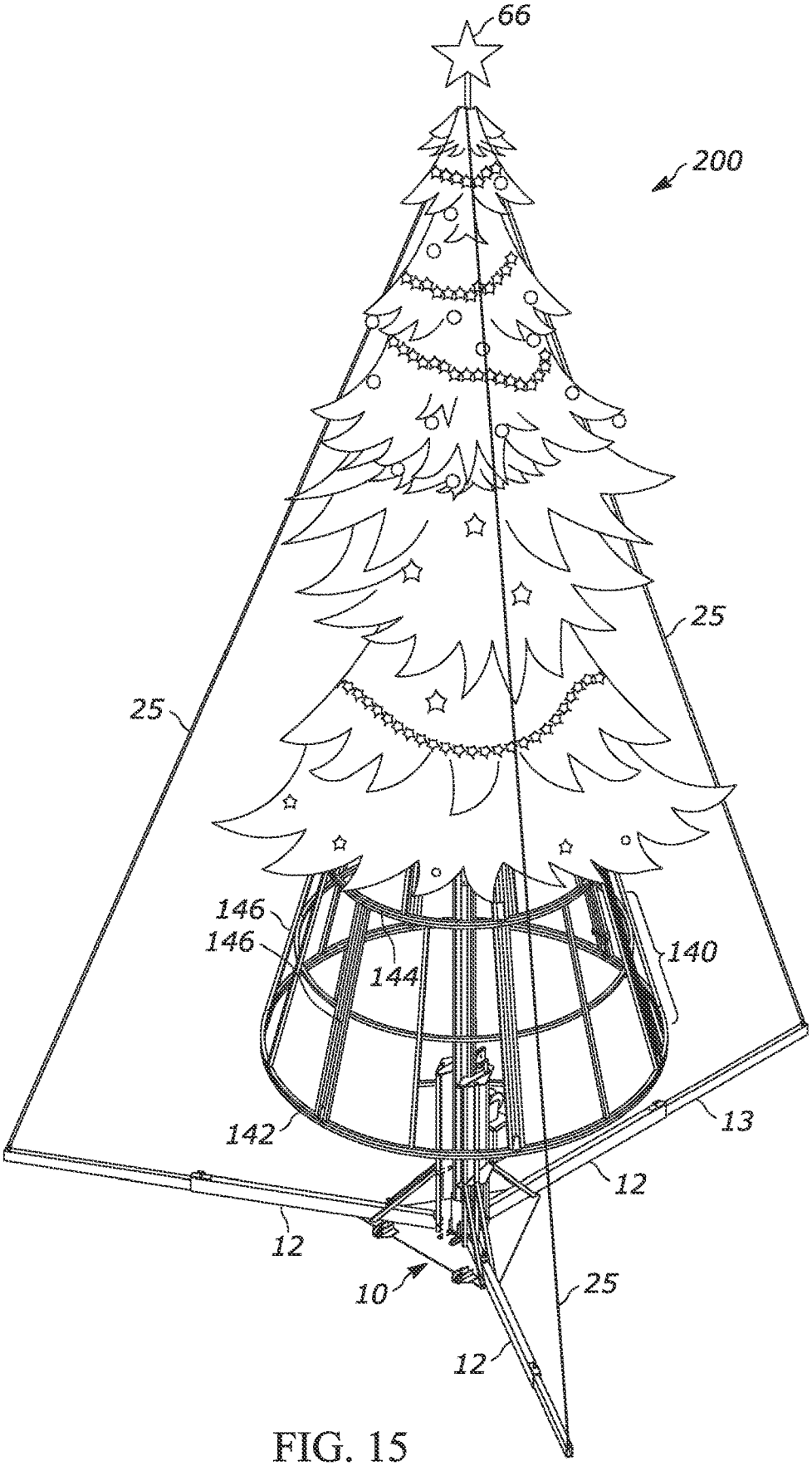

As shown in FIG. 15, the assembly comprising tree frame sections 70 and 130 is moved longitudinally along the support 20 toward the distal end portion 24 of the support, such as disclosed herein (e.g., manually or using winch). With the proximal end 132 of the preceding frame section 130 raised sufficiently above the base 10, a next frame section 140 is coupled around the support 20 beneath the preceding frame section 130, as shown in FIG. 15. In the example of FIG. 15, the frame section 140 is in the shape of a conical frustum. For example, the frame section 140 includes multiple annular sectors that collectively span 360 degrees and are coupled together along respective abutments (e.g., by nuts and bolts or other fasteners) to form the conical frustum shape. The frame section 140 includes a proximal end 142 and an opposing distal end 144 and braces extending longitudinally between the respective ends. The distal end 144 has a smaller diameter than the proximal base end 142. For example, the distal end 144 has the same size and is configured for coupling to the proximal end 132 of the preceding frame section 130. With the distal end 144 aligned with the end 132 in an abutment, the respective frame sections 130 and 140 can be coupled together (e.g., by nuts and bolts or other fasteners), such as described herein. Tree features 83 can also be coupled to the frame section 130, such as disclosed with respect to FIGS. 12, for forming artificial Christmas tree. As described herein, the height of the frame section 140 can be adjusted to a desired height during application of tree features (e.g., by hoist 90, such as using remote control 126).

Figure 16:
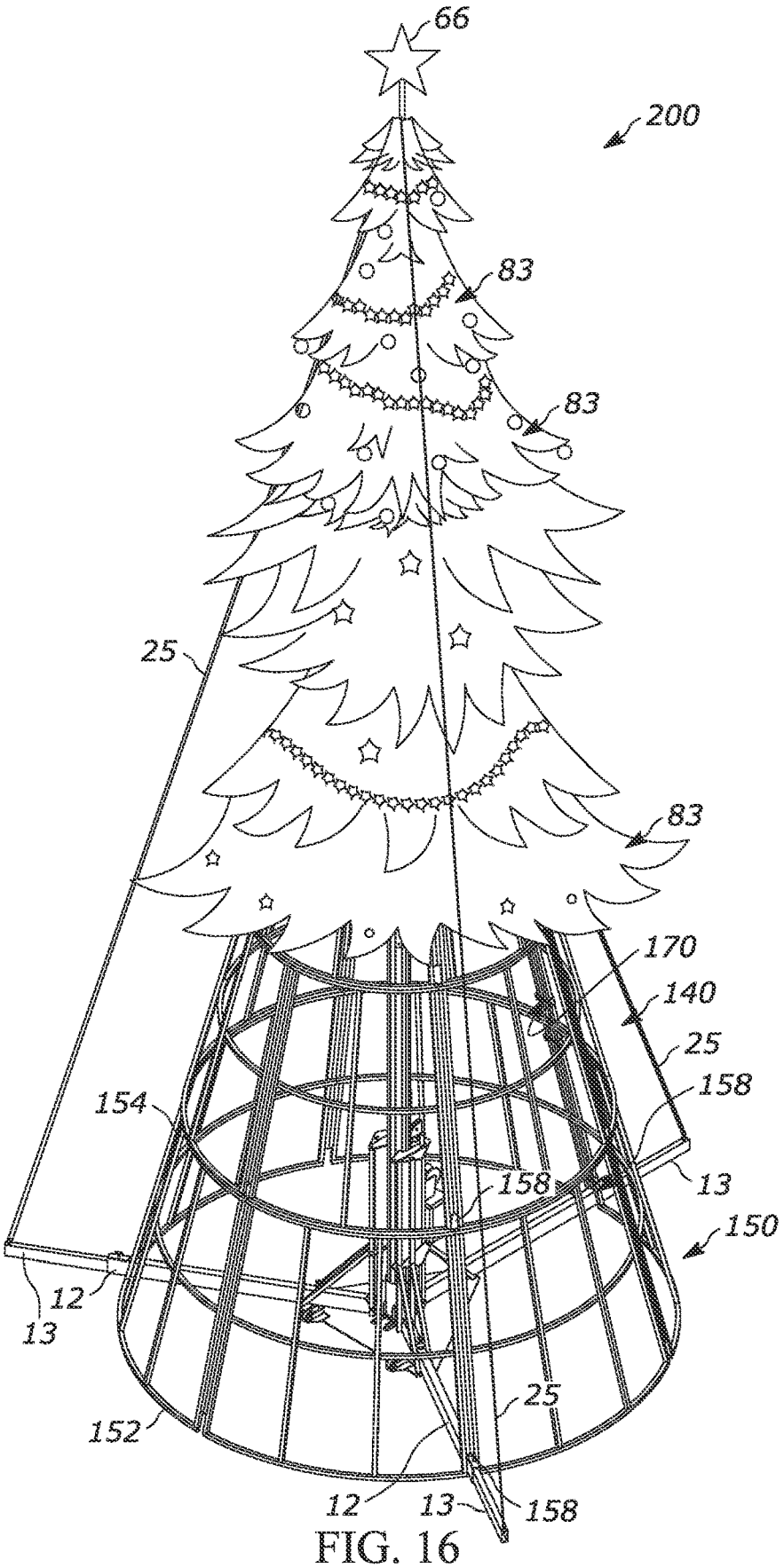

As shown in FIG. 16, the frame assembly comprising frame sections 70, 130 and 140 is moved longitudinally along the support 20 toward the distal end portion 24 of the support, such as disclosed herein (e.g., manually or using winch). With the proximal end 142 of the preceding frame section 140 raised sufficiently above the base 10, the next frame section 150 is coupled around the support 20 beneath the preceding frame section 130, as shown in FIG. 16. For example, the frame section 150 includes multiple annular sectors that collectively span 360 degrees and are coupled together along respective abutments (e.g., by nuts and bolts or other fasteners) to form a conical frustum shape. The frame section 150 includes a proximal end 152 and an opposing distal end 154 and respective braces extending longitudinally between the respective ends. The distal end 154 has a smaller diameter than the proximal end 152. For example, the distal end 154 has the same size and is configured for coupling to the proximal end 142 of the preceding frame section 140. With the distal end 154 aligned with the end 142 in an abutment, the respective frame sections 140 and 150 can be coupled together (e.g., by nuts and bolts or other fasteners), such as described herein.

In this example of FIG. 16, the frame section 150 is designed as the last frame section for artificial Christmas tree 200 being assembled. Accordingly, the height of the frame section 140 can be adjusted (e.g., by hoist 90, such as using remote control 126, or other means) to a desired height to facilitate application of tree features, if there is still room to lift the frame section 150 along the support. Tree features 83 can also be coupled to the frame section 150, such as disclosed herein to form the final artificial Christmas tree 200, such as shown in FIG. 17. Additionally, to improve stability of the final artificial Christmas tree 200, notches 158 are formed in the proximal base end 152. The notches 158 are arranged and configured to allow legs 12 or 13 to be received in respective notches so that the proximal end 152 portion of the base frame 150 between the legs can rest directly on the ground (or other surface on which the base 10 is placed). Other frame sections 140, 130 or 70 could include similarly configured notches 158, such as in situations when they might be used as the lower-most frame section of the artificial Christmas tree 200.

After the artificial Christmas tree 200 has been assembled, the guy wires 25 can be removed as shown in FIG. 17. If desired, the telescoping leg portions 13 can be retracted or removed from the base 10. The main legs 12 can remain in place or also can be removed. In this way such support features will not detract from the aesthetics of the fully assembled tree.

The artificial Christmas tree 200 further can include electrical lines and connectors (e.g., along an interior passage of the respective frame sections and/or along an exterior of the frames—not shown). The electrical lines and connectors are configured to supply electrical power to lights or other electrically powered decorations on the branches that are attached to the frames to receive electrical signals for operation. For example, plug-type electrical connections may be made between adjacent frame sections when connected together.

The sizes and number of respective frame sections can vary depending on the length of the artificial Christmas tree 200 being assembled. In an example, the artificial Christmas tree is a tall tree having a height of at least ten feet. In other examples, the tree is a tall tree having height of at least twenty feet, at least thirty feet, at least sixty feet or higher. The systems, trees and methods of assembly disclosed herein are equally applicable to an artificial Christmas tree having any height.

The artificial Christmas tree 200 may also be disassembled, such as by performing the sequence shown in FIGS. 5-17 in a reverse order. For example, the guy wires 25 may be reattached and the telescoping legs extended to provide increased stability during the disassembly process. The branches can be removed from lowest installed frame section, and the frame section can be disconnected from its preceding frame section and removed from the artificial Christmas tree 200. The group of remaining frame sections is lowered toward the base 10 and the disassembly process is repeated until all the frame sections have been removed. The branches may remain attached or they can also be removed. After the frame sections have been removed, the elongated support 20 is moved from its erect position to its prone position, and the support can be disconnected from the base 10. The base, frame sections, tree features, flexible elongated members and other parts and equipment may be transported and stored in a suitable storage location.

Figure 18:
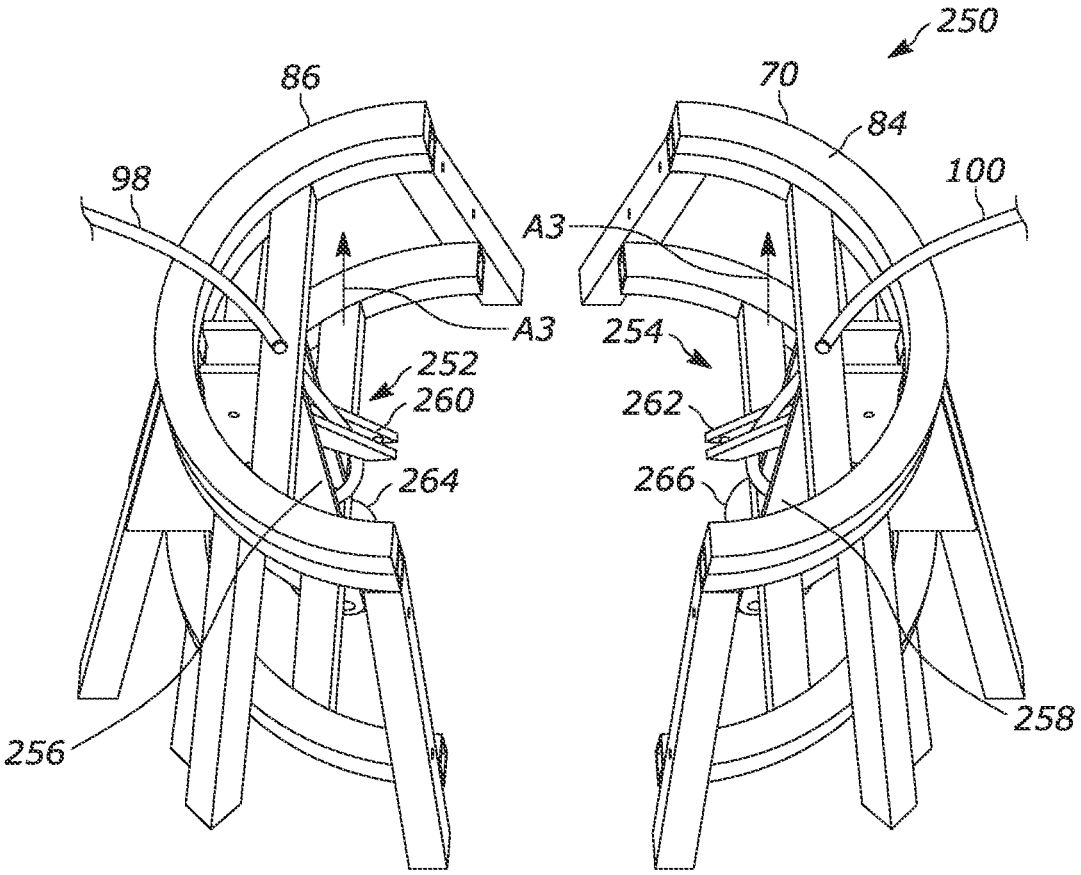
FIGS. 18-20 depict an example of brake apparatus implemented in a respective frame section of an artificial Christmas tree.
Figure 19:
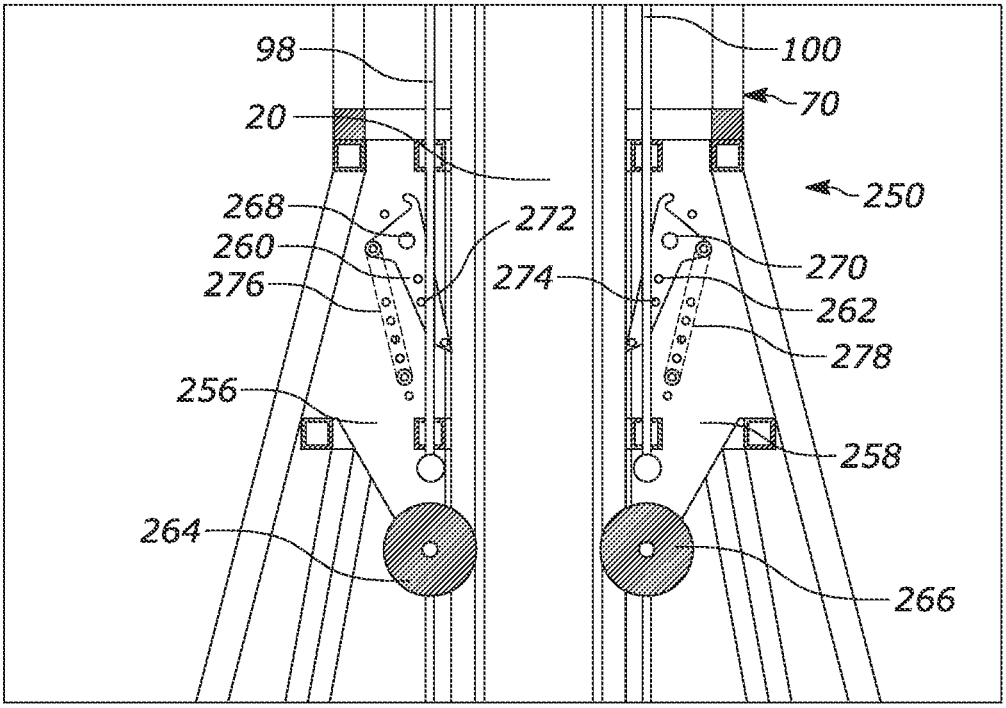
Figure 20:
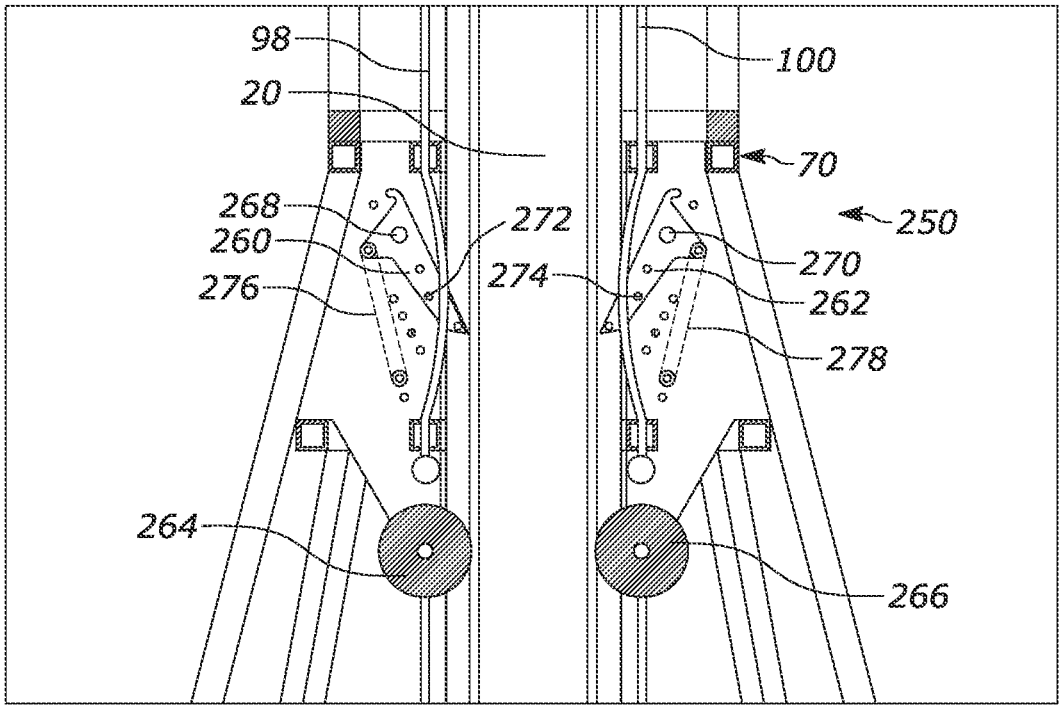

In some examples, the artificial Christmas tree can include a brake system 250. The brake system 250 is coupled to at least one of the frame sections, such as an uppermost frame section 70. In another example, one or more respective frame section may include a respective brake system. For example, the brake system 250 may be coupled within the first frame section 70 and one or more other frame sections may be connected directly or indirectly to the first frame section. The brake system 250 is adapted to actuate braking responsive to free-fall axial movement of at least one of plurality of frame sections in the longitudinal direction along the support 20, such as in the unlikely event that the frame section becomes disconnected from the hoist 90. FIGS. 18, 19 and 20 show an example of a brake system 250.

In the example of FIG. 18, the brake system 250 includes brake apparatuses 252 and 254 coupled to frame sector portions 84 and 86 of the frame section 70. Each brake apparatus 252, 254 can reside opposite sides of the elongated support, when the frame sectors are coupled together around the support, as disclosed herein. Each brake apparatus 252, 254 includes a respective braking member 260, 262. The braking members 260 and 262 are mounted within brake housing portions 256, 258, and are biased radially inwardly toward the support 20 (e.g., by one or more springs 276, 278—not shown in FIG. 18). For example, braking members 260 and 262 are coupled to brake housing portions 256 and 258 by a coupling (e.g., pivot member or other structure) arranged and configured to enable movement of braking members into and out of engagement with the support 20. The flexible elongated members 98 and 100 can be configured to hold braking members 260 and 262 away from the support 20 when the flexible elongated members are taut. In the example shown in FIG. 19, when the flexible elongated members 98 and 100 provide tension to support the frame section 70, the flexible elongated members 98 and 100 engage an arm, pin, roller or other structure, shown at 272 and 274, to move and hold the braking members 260 and 262 out of engagement from the support 20 (see, e.g., FIG. 19). When the tension is removed (e.g., in response to a cable snapping or otherwise released), the springs 276 and 278 drive respective braking members 260 and 262 into engagement with the support 20 (see, e.g., FIG. 20), thereby stopping the downward movement of the frame section 70 as well any other frame sections that may be coupled to the frame section. The brake apparatus 252, 254 can also include a wheel (or other guide) 264, 266 arranged and configured to hold the brake apparatus at a prescribed alignment with respect to the elongated support 20 and to facilitate longitudinal movement of the frame section 70 along the support, including during assembly and disassembly.

For example, so long as the flexible elongated members 98, 100 are applying force in a direction of arrow A3 (shown in FIG. 18), which results in sufficient tension in the flexible elongated members 98, 100, the brake system 250 is configured to permit substantially free longitudinal movement of the frame section 70 along the elongated support 20. The weight of the first frame section (individually or in combination with any other connected frame sections) can provide sufficient tension on the flexible elongated members 98, 100, which holds the braking members 260 and 262 away from the support 20 to enable the longitudinal movement of the frame section(s) along the support 20. If the flexible elongated members 98, 100 no longer apply force in the direction A3 so the tension is removed or the braking apparatus is otherwise activated, the braking members 260 and 262 are actuated to apply frictional and/or other forces to the support 20 to decelerate and/or to prevent further axial movement of the brake system 250 and each frame section that is operatively coupled to the brake system.

FIGS. 19 and 20 depicts an example of the brake system 250 with parts of the frame section 70 and brake system removed to show a portion of each brake apparatus 252, 254 coupled around the elongated support 20. In FIG. 19, the flexible elongated members 98, 100 are taut through each brake apparatus 252, 254 in response to force applied upwardly on the flexible elongated members 98, 100. Thus, flexible elongated members 98, 100 engage respective pins 272, 274 to move each braking member 260, 262 away from the support 20. As a result, the brake system 250 is configured in a released position to allow for substantially free movement of the frame section 70 along the support 20, as described herein.

In the example of FIG. 20, the brake system 250 is activated in response to terminating the application of upward force on the flexible elongated members 98, 100. As a result of the tension in the flexible elongated members 98, 100 being removed, springs 276 and 278 drive the braking members 260 and 262 radially inwardly to engage the elongated support 20 and apply force to the support 20 for braking the frame section 70 (e.g., along with any other frame sections coupled to such frame section). For example, the braking system 250 can be configured to automatically actuate in response to the tension in the flexible elongated members 98, 100 being removed. The brake apparatus 250 thus is free to move axially along the support 20 while there is tension in the flexible elongated members 98, 100 (e.g., due to upward force being applied). In response to terminating the application of force on the flexible elongated members 98, 100, the brakes 252, 254 are actuated to stop axial movement along the support 20.

Figure 21:
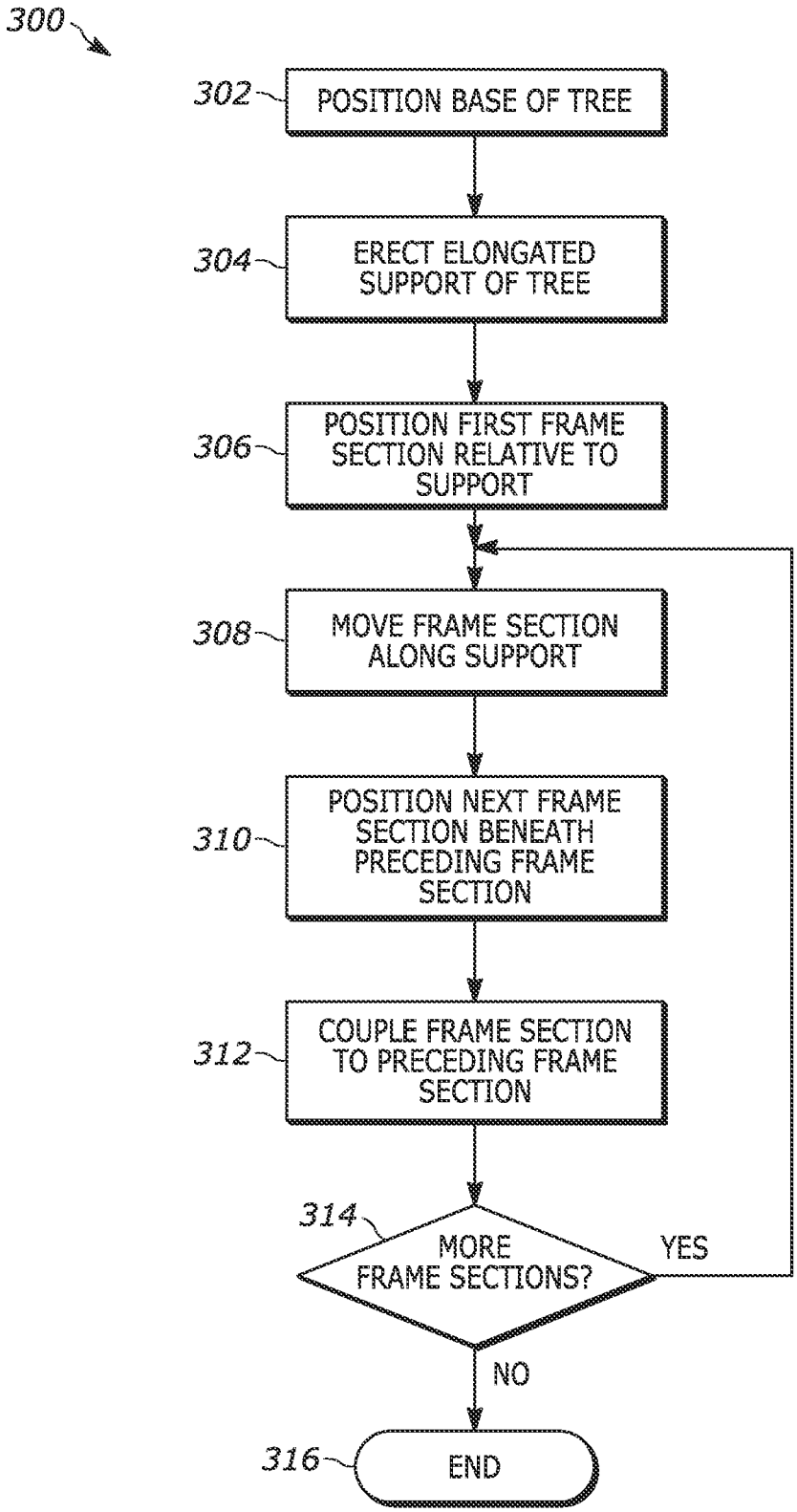
FIG. 21 is a flow diagram depicting an example of a method to assemble an artificial Christmas tree.

FIG. 21 is a flow diagram depicting an example of a method 300 to assemble an artificial Christmas tree, such as the artificial Christmas tree 200. Accordingly, the method 300 also refers to artificial Christmas tree 200 and its assembly or disassembly, as shown in FIGS. 1-20. At 302, the method 300 includes positioning the base 10 at a desired location where the tree is to be displayed. With the base in position, legs may be coupled and/or extended from the base 10 (see, e.g., FIG. 5).

At 304, the method includes erecting the elongated support of the tree so a distal end portion of the support is above an opposite proximal end portion of the support distal end portion of the support is above the base. For example, a hoist 50 is used to move the support 20 from the prone position to the erect position (see, e.g., FIGS. 7-9). The support 20 can be coupled to the base 10 to enable movement of the support between the prone position and the erect position. For example, the base 10 includes a mounting post 16 moveable between respective prone and erect positions thereof, and the proximal end portion of the support is coupled to the mounting post prior to erecting the support at 304. When the support has been erected, the support can be retained the erect position with respect to the base, such as by retainer 26 (see, e.g., FIG. 9). As disclosed herein, the support 20 can be moved to the erect position (e.g., with or without the hoist 50) prior to any frame sections being coupled around the support. In a further example, one or more tree toppers 66 can be coupled at the distal end portion of the support prior to erecting the support at 304.

At 306, a first frame section is positioned relative to the support. For example, the first frame section 70 can be coupled around the elongated support 20 by coupling respective frame sectors 84 and 86 together (see, e.g., FIGS. 10-11). At 308, the method 300 also includes moving the first frame section along the support toward the distal end portion of the support. For example, a hoist 90, which is coupled to the support, can be used to move the first frame section 70 along the support 20. The support 20 further can include passage extending longitudinally through the support with openings 94 and 96 near each of the proximal and distal end portions 22 and 24 of the support. The hoist 90 can include a winch, an arrangement of pulleys and a flexible elongated member that extends through the passage of the support and is coupled to the first frame section. A length of one or more flexible elongated members 98, 100 thus can traverse the passage when moving one or more frame sections at 308 by using the hoist.

Additionally, in some examples, prior to raising any frame section along the support more than a predetermined distance sufficient for placing a next frame section around the support between the base and a preceding frame section, the method 300 includes attaching tree features 83 to the frame section. This can include attaching branches to the one or more frame sections and/or decorating at least some of the branches. As an example, a user may hoist the preceding frame section(s) a few feet off the ground to facilitate attaching branches and decorations to such preceding frame section. In this way, the user can attach branches and decorations while standing instead of kneeling or sitting on the ground adjacent the frame section. In some examples, the height may be adjusted (e.g., up or down) throughout the process of attaching branches and decorating. Once branches and decorations have been applied to a given frame section, the given frame section may be move upwardly along the support a distance that is greater than or equal to the predetermined distance to enable the next frame section to be attached. As described herein, the branches and/or decorating can be implemented without requiring use of a ladder or other extension equipment.

At 310, a next frame section is positioned beneath the preceding frame section. At 312, the next frame section is coupled to the preceding frame section. For example, after the first frame section 70 has been decorated, the first frame section 70 can be moved longitudinally along the support 20 to provide space between the base 10 and the proximal end 74 of the first frame section for the next frame section 130 (see, e.g., FIGS. 11-13). Frame sectors of the next frame section 130 can be coupled to each other around the support, and the distal end 134 of the next frame section 130 can be coupled to the proximal end 74 of the first frame section 70 (see, e.g., FIG. 13). To facilitate coupling the ends 74 and 134 of the frame sections 70 and 130 together, the first frame section 70 may be lowered (e.g., by hoist 90) onto the next frame section 130.

At 314, a determination is made whether there are any additional frame sections that are to be assembled as part of the tree. If additional frame sections are to be used (yes), the method returns from 314 to 308 to repeat the steps at 308, 310 and 312 for each subsequent frame section to form the artificial Christmas tree. Because the proximal end of a given frame section is adapted to be coupled to a distal end of another frame section, movement of the given frame section along the support (e.g., by hoist 90) causes corresponding movement of each other frame section to which the given frame section is coupled. When it is determined at 314 that no additional frame sections are to be added, the method ends at 316.

As disclosed herein, the order of the method 300 may be reversed to disassemble the artificial Christmas tree. For example, disassembly can include removing each frame section from the support, moving the remaining frame sections in a longitudinal direction toward the base 10 and repeating the removal of frame sections until all have been removed from the support. Then, the support can be moved from the erect position to a prone position, such as in which the support is placed on the ground or other surface structure near the base. As further disclosed, the artificial Christmas tree can be configured as a kit having a prescribed set of frame sections that can vary depending on a height of the tree. The elongated support 20 further can include multiple longitudinal support portions, which can be coupled together axially between the proximal and distal end portions of the support (see, e.g., FIG. 3). In some examples, such as for very tall and/or heavy trees, the tree can include a brake system (e.g., brake system 250). In an artificial tree that includes a brake system and in the unlikely event that one or more frame sections were to fall downwardly along the support (e.g., if the flexible members 98, 100 were to release, snap or otherwise unable to provide tension to hold the frame section 70), the method 300 further can include automatically actuating the brake system in such event. In response to being actuated, the brake system can decelerate or prevent movement of the frame section(s) along the support in a direction from the distal end portion of the support to the proximal end portion of the support (see, e.g., FIGS. 18-20).

As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

As described herein, an artificial Christmas tree can be assembled and disassembled by hoisting respective frames in a longitudinal direction over an assembly (or disassembly) position. The hoisting can be implemented by lifting respective frame sections from above, such as described with respect to FIGS. 4-17 and 21. In another example, the hoisting can be implemented by lifting or lowering respective frame sections from a hoist located within the tree frame, such as described with respect to FIGS. 22-24. Accordingly, those skilled in the art will appreciate various configurations of hoists that can be implemented to raise and lower frame sections for assembly and disassembly based on this disclosure.

Figure 22:
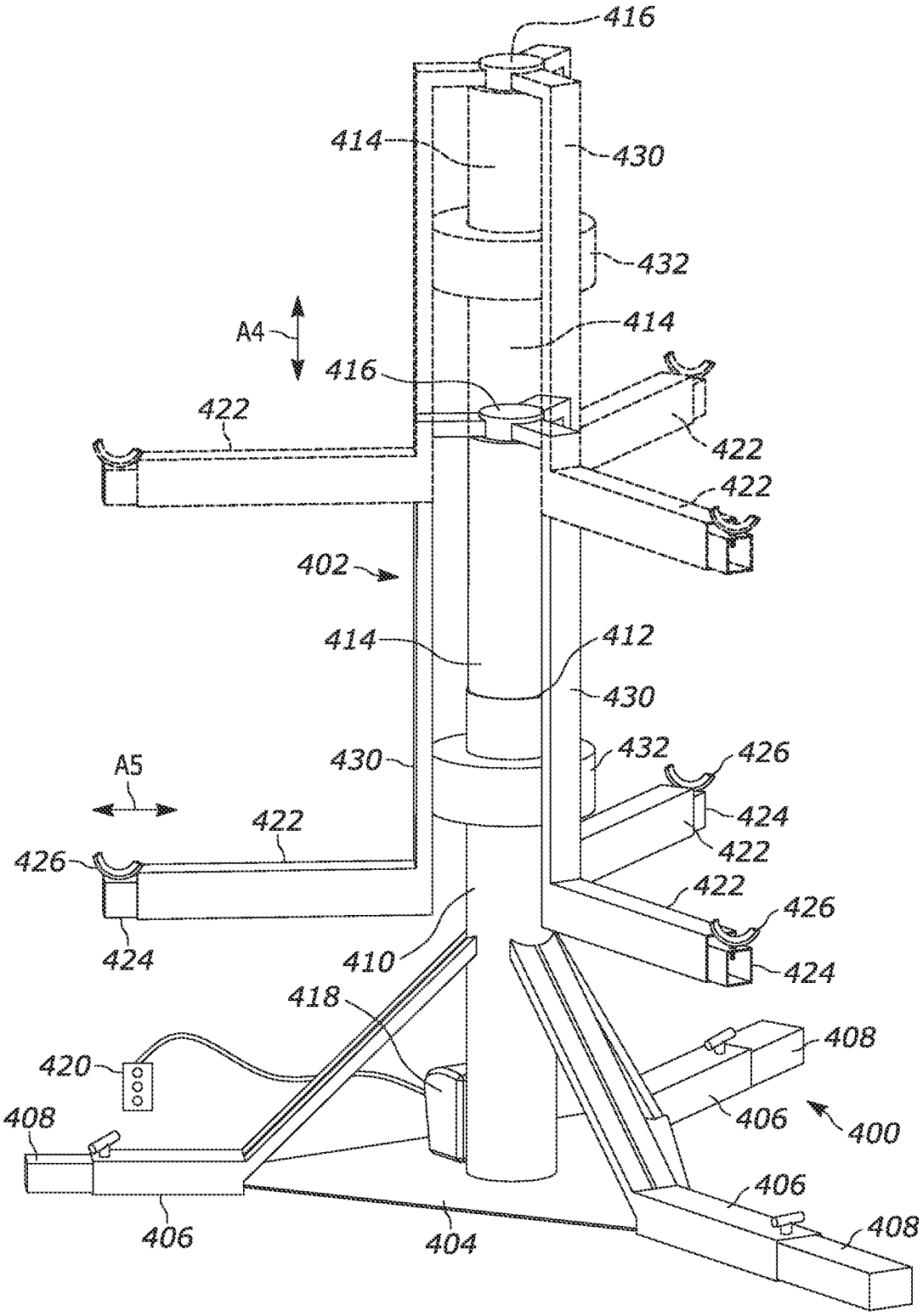
FIG. 22 is an example of a base that includes a hoist.
Figure 23:
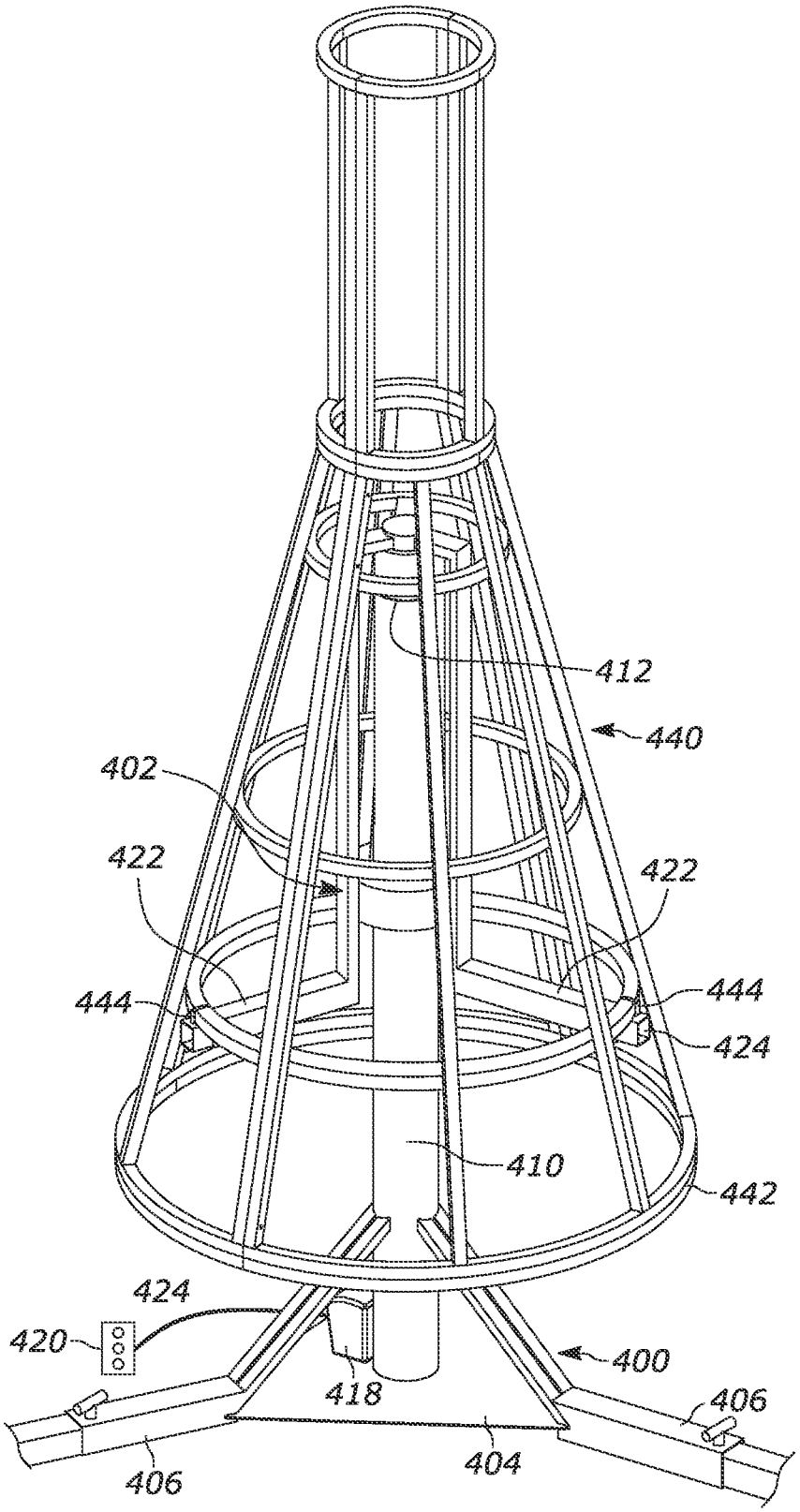
FIGS. 23-24 depict another example of a process for assembling frame sections of an artificial Christmas tree.
Figure 24:
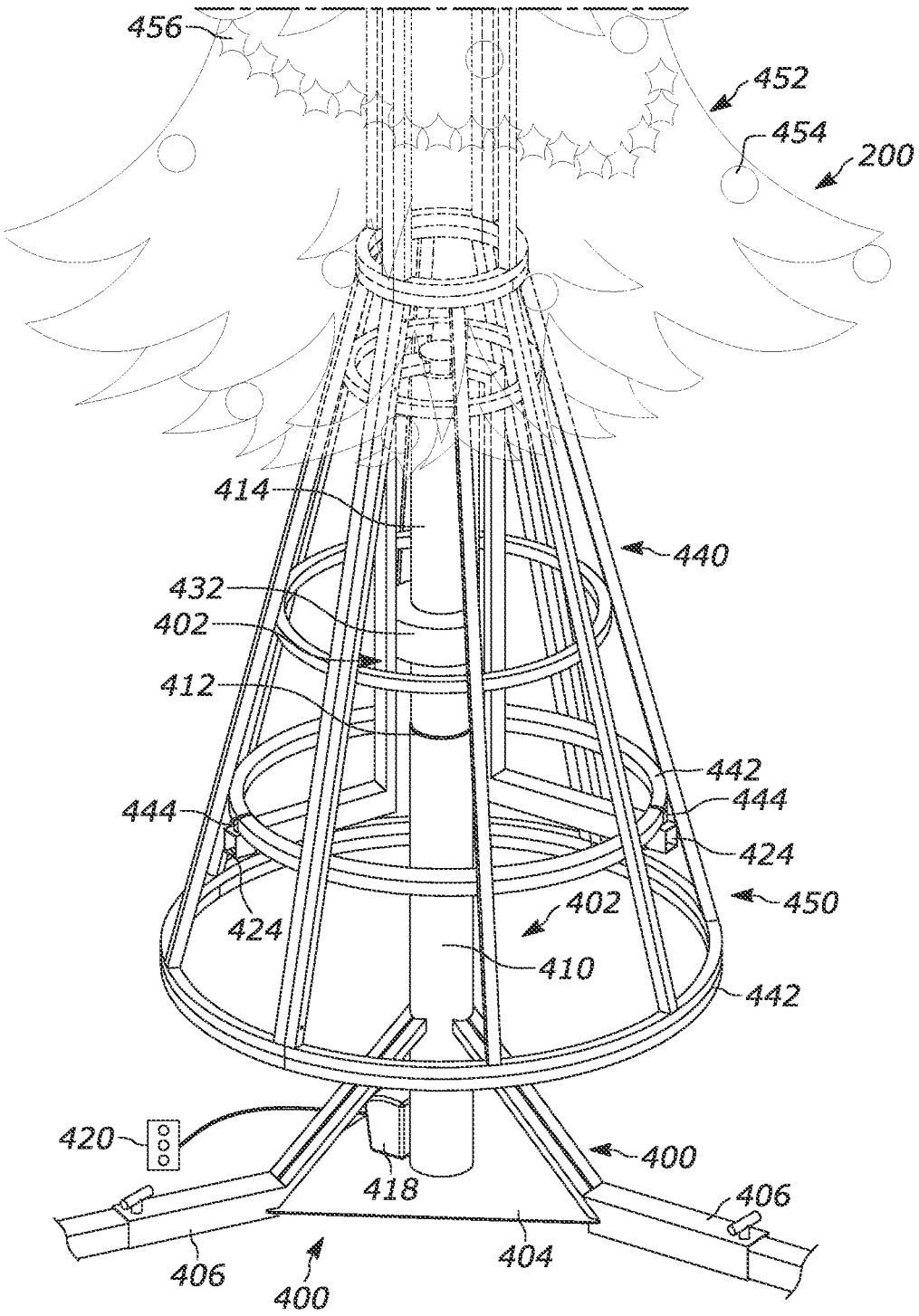

FIGS. 22-24 depict an example of a central base 400 that can be part of an artificial Christmas tree 200, such as disclosed herein. For example, the central base 400 can be located at a central position within a frame of the artificial Christmas tree 200 being assembled or disassembled. In the example of FIGS. 22-24, the base 400 includes a hoist 402 arranged and configured to move one or more frame sections in a longitudinal direction above an assembly (or disassembly) position. For example, the hoist can contact part of a lower frame section and lift (or lower) the frame section, along with any frame sections coupled to it, from below. The base 400 includes a central base portion 404 that can be placed on a surface (e.g., ground) at a desired assembly location, which typically also is the display location. The hoist 402 can be arranged at the central base portion 404. One or more wheels (not shown) can be coupled to the central base portion 404 to facilitate movement of the base 400 across the surface, such as described herein.

The base 400 can also include a number of legs 406 extending outwardly from the central base portion 404 of the base 400. The legs 406 may be coupled to the central base portion 404 by one or more fasteners, as described herein. The legs 406 are configured to provide additional stability, such as by increasing the effective diameter of the central base portion. In some examples, the legs 406 may include telescoping leg portions 408 to provide adjustable lengths that may be set by a user. As disclosed herein, the telescoping leg portions 408 are adapted to provide additional support and stability by further increasing the effective diameter of the base 400, such as during assembly and/or disassembly of the tree 200.

In the example of FIGS. 22-24, the hoist 402 is a lift mechanism that includes an elongated central barrel portion 410 extending outwardly from (e.g., orthogonal to) the central base portion 404 to terminate in a distal end 412 thereof. The central barrel 410 can be fixed with respect to the base support portion 404 (e.g., by welding and/or use of fasteners). The central barrel 410 is adapted to support an elongated rod (e.g., a piston rod) 414, which is movable with respect to the central barrel 410. The rod 414 thus extends a variable distance from the distal end 412 of the barrel 410 to terminate a distal rod end 416. The central barrel 410 includes one or more adjustment mechanisms arranged and configured to move the rod 414 in a longitudinal direction (e.g., axially) relative to the central barrel, to thereby adjust the distance that the rod extends from the central barrel. That is, the hoist 402 is moveable between its compressed position (shown in solid lines) and its extended position (shown in dashed lines) in a longitudinal direction of the tree frame, shown at A4, for raising and lowering frame sections, such as described herein.

The adjustment mechanism(s) can be coupled to a proximal end of the rod 414 (not shown) within the barrel 410, and include mechanical, hydraulic, electrical, and/or electromechanical mechanisms configured to move the rod 414 relative to the barrel 410. In some examples, the adjustment mechanism of the hoist 402 is controllable by an actuator, shown at 418, which is coupled to (e.g., part of) the hoist. The actuator 418 can be an electrical and/or mechanical actuator configured to implement desired movement of the rod with respect to the barrel 410, namely to raise or lower the distal end 416 of the rod 414. In an example where the actuator 418 implements electrical actuation, a controller 420 can be coupled to the actuator 418 and be adapted to activate or deactivate the actuator 418 responsive to a user input (e.g., by pressing a respective button on a human-machine interface of the controller 420).

In the example of FIGS. 22-24, the hoist 402 includes an arrangement of arms 422 coupled to the distal end 416 of the rod 414. The arms 422 can extend radially outwardly from the rod 414 and terminate in respective distal end portions 424. The distal end portions 424 can be adapted to contact braces or annular support portions of a frame section. In one example, a support bracket (e.g., a curved or generally U-shaped bracket) 426 can be mounted at each of the distal end portion 424. The support bracket 426 can be arranged and configured at the distal end portion 424 to grasp or hold a portion of a frame section during hoisting thereof, such as during assembly or disassembly of the tree 200 (see, FIGS. 23 and 24). In some examples, the support bracket can swivel to facilitate alignment with braces or support portions of the frame sections. Additionally, or alternatively, straps (e.g., rubber, nylon or the like) or ties can be attached to the support brackets 426 or another part of the distal end portion 424 to help hold the frame sections in place with respect to the arms 422, such as when the frame sections are being lifted up or down by the hoist 402.

In some examples, the distal end portion 424 of the arms 422 may be implemented as telescoping arms to provide variable arm lengths, which can be adjusted by a user according to the size of the frame section being hoisted. For example, the telescoping distal arm 424 may extend axially from the main part of the respective arms 422. As shown in the examples of FIG. 22, the telescoping distal arm portions 424 are each moveable axially with respect to the respective main arms 422 in the direction of an arrow, shown at A4.

As a further example, the arms 422 can include proximal arm portions 430 that are coupled to the distal end 416 of the rod 414. The proximal arm portions 430 can extend longitudinally from the distal end 416 of the rod 414 in a direction towards the central base portion 404. The proximal arm portions 430 can also extend substantially parallel to and be spaced radially outwardly from an outer sidewall of the central barrel 410. The main arm portions 422 can extend from the ends of the proximal arm portions outwardly away from the central barrel 410. For example, the main arm portions 422 can extend transversely away from the ends of respective proximal arm portions 430, such as at an angle ranging from about 70 degrees to about 110 degrees (e.g., about 90 degrees). The main arm portions 422 can be fixed to or integrally formed with the proximal arm portions 430. Alternatively, the main arm portions 422 can be able to move longitudinally along the length of the proximal arm portions 430, such as to adjust the height of the main arm portions (e.g., without actuating the hoist 402).

One or more spacing collars 432 can be coupled to an intermediate location of the proximal arm portions 430. The spacing collar 432 is arranged and configured to facilitate movement of the collar longitudinally along the central barrel 410 and, when the hoist 402 is extended a sufficient length, also along the rod 414. For example, the collar 432 is formed of a rigid material and is configured to support the proximal arm portions 430 in a fixed arrangement and to space the arm portions 430 away from the outer sidewall of the central barrel 410. A radially inner surface of the collar 432 can include a coating, bearings, rollers or other feature to facilitate its longitudinal motion along the barrel 410 and rod 414 during hoisting.

In FIG. 23, a frame section 440 is shown being lifted above the surface at an assembly location. The frame section 440 can be any of a number of frame sections that can be coupled together to form the frame of the artificial Christmas tree 200. The frame section 440 can include an arrangement of annular sectors or be implemented according to other configurations, such as described herein. The support brackets 426 can be arranged and configured to hold respective annular frame supports 442 of the frame section 440, such as by adjusting the length of the respective distal end portions 424 to match the diameter of the frame supports 442 being held by the support brackets 426. When positioning the support brackets 426, the hoist 402 can be actuated to raise or lower the arms at an appropriate height for contacting the frame support 442. As shown in the examples of FIGS. 23 and 24, the support brackets 426 can hold an intermediate (or upper) frame extension from a lower edge, and the frame can be strapped in place by one or more straps 444. In other examples, the support brackets 426 can grasp other parts of the frame (lateral or vertical extending frame supports) from other angles such as from above or from the side. After the frame section 440 is secured to the support bracket 426 (or another part of the arm 422), a user can control the actuator 418 to raise or lower the frame section for assembling and disassembling the artificial Christmas tree. For assembly, the hoist 402 is configured to lift a given frame section along with one or more other frame sections, if they have been already assembled into the tree, to provide sufficient height to insert a next frame section between the previous frame section and the ground. For disassembly, the hoist 402 is thus configured to attach to and lift a frame section that is above the lower-most frame section being removed, and after the lower-most frame has been removed, the previous frame section can be lowered onto the ground and the disassembly process repeated.

FIG. 24 show the artificial Christmas tree 200 at an intermediate stage of assembly or disassembly using the hoist 402 to raise or lower the frame sections 440 and 450 of the tree. For example, a second frame section 450 has its distal end aligned with and abutting the proximal end of the frame section 440, and the respective frame sections 440 and 450 can be coupled together (e.g., by nuts and bolts or other fasteners), such as described herein. The process of adding or removing frame sections, including using the hoist 402 to raise or lower the frame section(s) as needed, can be repeated for each frame section until the process of assembling or disassembling the tree is complete. As shown in FIG. 24, the tree 200 can include branches with an arrangement of artificial foliage (e.g., needles or other leaves) 452, ornaments 454, lights and/or other decorations 456, which can be attached to one or more of respective frame sections 440 and 450.

For example, with reference to FIGS. 23 and 24, a method of assembling an artificial Christmas tree will be described. The method includes positioning a given frame section 440 of an artificial Christmas tree 200 at the assembly location. Frame sectors can be assembled together to form a frame section 440 around the base 400, such as described herein. The height and length of the arms 422 can adjusted to align the support brackets 426 with desired portions of the frame section 440 for lifting. Once in alignment (e.g., with support brackets holding the frame), the frame section(s) can be moved in the longitudinal direction above the assembly location, such as shown in FIG. 23. The hoist 402 can be controlled (e.g., using the controller 420) to move the proximal (bottom) end of the frame above the surface a distance at least equal to a height of a next frame section to be added.

A next frame section 450 can be assembled and positioned beneath the previous frame section 440. The next frame section 450 can then be coupled to the previous frame section. For example, the previous frame section(s) can be lowered onto the next frame section 450 for attachment (e.g., by fasteners). A user can control the hoist 402 to move the first and second frame sections 440 and 450, as a unit, in the longitudinal direction so the most recently attached frame section 450 rests on the ground (or on the legs 406). While resting on the ground, the straps 444 can be loosened and removed from holding the frame section 440, and the hoist lowered further. The distal end portions 424 can be adjusted to align support brackets 426 with a frame section of the lower (e.g., bottom) frame section 450. During such alignment, the hoist 402 can be actuated so the support brackets 426 can contact and hold the frame support, and straps 444 can applied to secure the frame to the arms 422. Once properly connected, the hoist 402 can be activated to move the frame sections, as a unit, longitudinally above the assembly location to provide sufficient space for the next frame section (if any). As mentioned, branches having an arrangement of artificial foliage (e.g., needles or other leaves) 452, ornaments 454, lights and/or other decorations 456 can also be attached to one or more of respective frame sections 440 and 450 prior to hoisting the frames for adding the next frame section. In some examples, lights can be coupled to at least some of the branches and electrical lines along the respective frame sections can be connected together to supply electrical power to the lights as well as other electrical features.

While the hoist 402 in FIGS. 22-24 is shown as a hydraulic-type lift, other types of hoists can be used in other examples, such as a scissor lift, a pneumatic lift, an accordion lift and the like. Additionally, by using the hoist 402 to lift from the bottom, the elongated central support (e.g., trunk) 20 can be omitted from the artificial Christmas tree. In other examples, the hoist 402 can be used with the support 20, such as by appropriate adaptations to the hoist and/or support.

As used herein, the term "and/or" can include any and all combinations of one or more of the associated listed items.

It will be understood that when an element is referred to as being "on," "attached" to, "connected" to, "coupled" with, "contacting", "adjacent", etc., another element, it can be directly on, attached to, connected to, coupled with, contacting, or adjacent the other element or intervening elements may also be present. In contrast, when an element is referred to as being, for example, "directly on," "directly attached" to, "directly connected" to, "directly coupled" with, "directly contacting", or "directly adjacent" another element, there are no intervening elements present. It will also be appreciated by those of skill in the art that references to a structure or feature that is disposed "directly adjacent" another feature may have portions that overlap or underlie the adjacent feature, whereas a structure or feature that is disposed "adjacent" another feature might not have portions that overlap or underlie the adjacent feature.

Spatially relative terms, such as "under," "below," "lower," "over," "upper", "proximal", "distal", and the like, may be used herein for ease of description to describe one element or feature's relationship to another element(s) or feature(s) as illustrated in the figures. It will be understood that the spatially relative terms can encompass different orientations of a device in use or operation, in addition to the orientation depicted in the figures. For example, if a device in the figures is inverted, elements described as "under" or "beneath" other elements or features would then be oriented "over" the other elements or features.

As used herein, the phrase "at least one of X and Y" can be interpreted to include X, Y, or a combination of X and Y.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present disclosure. The sequence of operations (or steps) is not limited to the order presented in the claims or figures unless specifically indicated otherwise.

Any of the described structures and components could be integrally formed as a single unitary or monolithic piece or made up of separate sub-components, with either of these formations involving any suitable stock or bespoke components and/or any suitable material or combinations of materials; however, the chosen material(s) should be biocompatible for many applications.

Though certain components described herein are shown as having specific geometric shapes, all structures of this disclosure may have any suitable shapes, sizes, configurations, relative relationships, cross-sectional areas, or any other physical characteristics as desirable for a particular application. Any structures or features described with reference to one aspect or configuration could be provided, singly or in combination with other structures or features, to any other aspect or configuration, as it would be impractical to describe each of the aspects and configurations discussed herein as having all of the options discussed with respect to all of the other aspects and configurations. A device or method incorporating any of these features should be understood to fall under the scope of this disclosure as determined based upon the claims below and any equivalents thereof.

What have been described above are examples. It is, of course, not possible to describe every conceivable combination of components or methodologies, but one of ordinary skill in the art will recognize that many further combinations and permutations are possible. Accordingly, the invention is intended to embrace all such alterations, modifications, and variations that fall within the scope of this application, including the appended claims.

What is claimed is:

1. An artificial Christmas tree, comprising:

a plurality of frame sections adapted to be assembled to form a tree frame, the tree frame having an outer frame portion adapted to support artificial tree features;

a hoist adapted to move one or more of the frame sections in a longitudinal direction of the tree frame;

a base;

an elongated support having a proximal end coupled to the base and an opposite distal end, the hoist coupled to at least one of the base and the support; and an additional hoist coupled to the base and adapted to move the support between respective prone and erect positions.

2. The artificial Christmas tree of claim 1, wherein the frame sections are adapted to circumscribe the support and are moveable relative to the support in the longitudinal direction along a length of the support.

3. The artificial Christmas tree of claim 1, wherein each respective frame section includes at least two annular sector portions that are coupled together along abutments thereof to circumscribe the support.

4. The artificial Christmas tree claim 1, further comprising a mounting post coupled to the base and moveable between a prone position and an erect position thereof, the mounting post being adapted to couple to the proximal end of the support so the support is moveable with the mounting post between respective prone and erect positions.

5. The artificial Christmas tree of claim 1, wherein the additional hoist comprises:

a winch; and a length of a flexible elongated member extending from the winch and coupled to the support at a location between the proximal and distal ends thereof, the winch being adapted to change the length of the flexible elongated member between the winch and the support to move the support between the prone and erect positions.

6. The artificial Christmas tree of claim 1, further comprising a retainer extending from a central portion of the base, the retainer adapted to retain the support in an erect position, wherein the retainer has an opening along a side thereof to receive a portion of the support in the erect position.

7. The artificial Christmas tree of claim 1, further comprising a brake apparatus coupled to at least one of the frame sections, the brake apparatus adapted to actuate braking responsive to free-fall axial movement of at least one of plurality of frame sections along the support in the longitudinal direction.

8. The artificial Christmas tree of claim 1, wherein the base includes legs coupled to and extending outwardly from a central portion of the base.

9. The artificial Christmas tree of claim 8, further comprising wheels attached to the base and configured to facilitate movement of the base across a surface.

10. The artificial Christmas tree of claim 8, wherein each of the frame sections has a proximal end and an opposing distal end, the proximal end of at least one of the frame sections including notches arranged and configured to receive the legs therein to allow the respective proximal end between respective notches to rest on a surface where the base and the legs are placed.

11. The artificial Christmas tree of claim 1, further comprising branches coupled to each of the frame sections, the branches adapted to extend outwardly from the respective frame sections.

12. The artificial Christmas tree of claim 11, further comprising:

lights coupled to at least some of the branches; and electrical lines along the respective frame sections to supply electrical power to the lights.

13. The artificial Christmas tree of claim 1, comprising a central base portion that includes the hoist, and the hoist is arranged and configured to raise and lower one or more of the frame sections from within the tree frame for moving the one or more of the frame sections in the longitudinal direction.

14. An artificial Christmas tree, comprising:

a plurality of frame sections adapted to be assembled to form a tree frame, the tree frame having an outer frame portion adapted to support artificial tree features;

a hoist adapted to move one or more of the frame sections in a longitudinal direction of the tree frame a base;

an elongated support having a proximal end coupled to the base and an opposite distal end, the hoist coupled to at least one of the base and the support, wherein each frame section has proximal and distal ends spaced longitudinally apart, the proximal end of a given frame section is adapted to be coupled to a distal end of another frame section, whereby axial movement of the given frame section relative to the support causes corresponding axial movement of each other frame section to which the given frame section is coupled.

15. An artificial Christmas tree, comprising:

a plurality of frame sections adapted to be assembled to form a tree frame, the tree frame having an outer frame portion adapted to support artificial tree features;

a hoist adapted to move one or more of the frame sections in a longitudinal direction of the tree frame a base;

an elongated support having a proximal end coupled to the base and an opposite distal end, the hoist coupled to at least one of the base and the support, a retainer extending from a central portion of the base, the retainer adapted to retain the support in an erect position, wherein the retainer has an opening along a side thereof to receive a portion of the support in the erect position, and wherein the retainer further comprises:

a latch adapted to hold the support the erect position; and an actuator adapted to release the support from being held by the latch.

16. An artificial Christmas tree, comprising:

a plurality of frame sections adapted to be assembled to form a tree frame, the tree frame having an outer frame portion adapted to support artificial tree features;

a base; and an elongated support having a proximal end coupled to the base and an opposite distal end, a hoist adapted to move one or more of the frame sections along the support in a longitudinal direction of the tree frame, wherein the hoist further comprises at least one flexible elongated member coupled to a given frame section, and the hoist is adapted to vary a length of the flexible elongated member between the given frame section and the distal end of the support to move at least the given frame section along the support in the longitudinal direction.

17. The artificial Christmas tree of claim 16, wherein the support has a passage extending longitudinally through the support with openings near each of the proximal and distal end portions of the support, another length of the flexible elongated member being capable of moving through the passage, wherein the hoist further comprises:

a winch coupled to the flexible elongated member and adapted to adjust the length of the flexible elongated member extending from the distal end of the support to move the given frame section in the longitudinal direction; and an arrangement of one or more pulleys to route the flexible elongated member between the given frame section and the winch.

* * * * *